US008990972B2

(12) United States Patent
Lopaciuk

(10) Patent No.: US 8,990,972 B2
(45) Date of Patent: Mar. 31, 2015

(54) METHOD AND APPARATUS FOR CONTROLLING WARE WASHING

(75) Inventor: David Lopaciuk, West Palm Beach, FL (US)

(73) Assignee: Auto Fill-N-Drain, Inc., West Palm Beach, FL (US)

( * ) Notice: Subject to any disclaimer, the term of this patent is extended or adjusted under 35 U.S.C. 154(b) by 777 days.

(21) Appl. No.: 13/324,643

(22) Filed: Dec. 13, 2011

(65) Prior Publication Data

US 2012/0097256 A1 Apr. 26, 2012

Related U.S. Application Data

(60) Provisional application No. 61/492,196, filed on Jun. 1, 2011.

(51) Int. Cl.
*A47K 3/022* (2006.01)
*A47L 15/00* (2006.01)

(52) U.S. Cl.
CPC ..... *A47L 15/0086* (2013.01); *A47L 15/0047* (2013.01); *A47L 15/0055* (2013.01); *A47L 2401/023* (2013.01); *A47L 2401/09* (2013.01); *A47L 2401/10* (2013.01); *A47L 2401/12* (2013.01); *A47L 2501/02* (2013.01); *A47L 2501/06* (2013.01); *A47L 2501/07* (2013.01); *A47L 2501/16* (2013.01)
USPC ..... 4/222; 4/640

(58) Field of Classification Search
USPC ..... 4/222, 639, 640
See application file for complete search history.

(56) References Cited

U.S. PATENT DOCUMENTS

| | | | |
|---|---|---|---|
| 805,118 | A | 11/1905 | Chamberlain |
| 3,717,159 | A | 2/1973 | Caviccioli |
| 3,807,418 | A | 4/1974 | Jenkins |
| 3,896,827 | A | 7/1975 | Robinson |
| 4,277,290 | A | 7/1981 | Andrews et al. |
| 4,439,242 | A | 3/1984 | Hadden |
| 4,456,022 | A | 6/1984 | Roberts |
| 4,689,089 | A | 8/1987 | Eberhardt, Jr. et al. |
| 4,756,321 | A | 7/1988 | Livingston et al. |
| 4,773,436 | A | 9/1988 | Cantrell et al. |
| 4,781,206 | A | 11/1988 | Noren |
| 4,810,306 | A | 3/1989 | Noren |
| 4,872,466 | A | 10/1989 | Noren |
| 5,137,041 | A | 8/1992 | Hall |

(Continued)

OTHER PUBLICATIONS

Champion Industries, "Taskmaster power wash sink system", Installation/Operation Guide, URL: http://www.championindustries.com, Ontario, Canada, (Mar. 4, 2011).

(Continued)

*Primary Examiner* — Huyen Le
(74) *Attorney, Agent, or Firm* — McHale & Slavin, P.A.

(57) ABSTRACT

A method and apparatus to control ware washing to provide and maintain health safety through the use of an automated system. The method and apparatus adheres and maintains to FDA/EPA standards which consistently clean water, high detergent, correct water temperature and sanitizer levels, to ensure the removal of all human DNA, oils and other food waste that could, when not properly removed after the three step washing process of wash, rinse and sanitize, form a bacterial growth on the kitchen cooking equipment, plates, glasses and utensils, contaminating future food and liquid use.

22 Claims, 22 Drawing Sheets

(56) References Cited

U.S. PATENT DOCUMENTS

| | | | | |
|---|---|---|---|---|
| 5,581,836 | A | 12/1996 | Kleber | |
| 5,660,194 | A | 8/1997 | Sanders | |
| 5,681,400 | A | 10/1997 | Brady et al. | |
| 5,775,347 | A | 7/1998 | Hoover et al. | |
| 5,927,309 | A | 7/1999 | Hoover et al. | |
| 5,934,309 | A | 8/1999 | Batten | |
| 5,939,974 | A | 8/1999 | Heagle et al. | |
| 6,021,788 | A | 2/2000 | King | |
| 6,089,242 | A * | 7/2000 | Buck | 134/57 R |
| 6,453,487 | B1 * | 9/2002 | Babington | 4/619 |
| 6,536,060 | B1 | 3/2003 | Janssens et al. | |
| 6,659,114 | B2 | 12/2003 | Bigott | |
| 7,372,039 | B2 | 5/2008 | Tokhtuev et al. | |
| 7,614,410 | B2 | 11/2009 | Kenowski et al. | |
| 7,652,267 | B2 | 1/2010 | Tokhtuev et al. | |
| 7,691,209 | B2 | 4/2010 | Reichold | |
| 7,731,154 | B2 | 6/2010 | Parsons et al. | |
| 7,989,780 | B2 | 8/2011 | Tokhtuev et al. | |
| 2003/0127110 | A1 * | 7/2003 | Reichold et al. | 134/18 |
| 2004/0068791 | A1 | 4/2004 | Fellencer | |

OTHER PUBLICATIONS

Metacraft, Inc., "Power Soak MX-220 Owner's Manual", URL: http://www.powersoak.com, Kansas City, MO, (Mar. 31, 2005).

Anonymous: "Power Soak product specifications", Kansas City, MO, URL: http://www.powersoak.com.

Mead, Paul et al: "Food-related illness and death in the united states", EID Journal, V5, #5, Atlanta, GA, URL: http://www.cdc.gov/ncidod/eid/vol5no5/mead.htm, (Oct. 1999).

Ducey, Joe et al: "Undercover investigation: dirty hotel drinking glasses", ABC news, New York City, NY, URL: http://www.abcnews.go.com/gma/businesstravel/story?id=42770678page=1, (Feb. 12, 2008).

Anonymous: "pH combination electrode", PGC scientifics, Palm Desert, CA, URL: http://www.pgcscientifics.com/ph-combination-electrode-p70-0205-02mp.htm.

Anonymous: "Hand-held ph meter—data logging system—recharging cradle—deltatrak—24201", Indianapolis, IN, URL: http://www.zesco.com/deltatrak-24201-hand-held-ph-meter-data-logging-system-pz77d002.htm.

* cited by examiner

METHOD AND APPARATUS FOR CONTROLLING WARE WASHING

CROSS-REFERENCE TO RELATED APPLICATION

This application claims the benefit of priority under U.S.C. 119(e) of U.S. Provisional Patent Application No. 61/492,196, filed Jun. 1, 2011, entitled METHOD AND APPARATUS FOR CONTROLLING WARE WASHING the entirety of which is incorporated herein by reference.

FIELD OF THE INVENTION

This invention is directed to the field of ware washing and, in particular, to a method and apparatus for controlling the quality of water and detergents used in ware washing.

BACKGROUND OF THE INVENTION

Ware washing equipment is employed to clean soiled utensils used most typically in bars and restaurants. A three bay commercial sink is used to provide a wash bay, rinse bay and a sanitize bay before allowing the utensils such as pots, pans, and glasses to air dry. The ware washing equipment becomes soiled and contaminated from use due to bacteria. In order to maintain sanitation, the pH, alkalinity, turbidity, quaternary ammonium level, in relation to its required water temperature in the sink bays must be measured and maintained.

Currently food service establishments rely on low paid kitchen labor to monitor and change the water and supply the necessary chemicals in ware washing. Reliance on their diligence is misplaced and can lead to contamination and failed health code inspections. Cleaning stations for soiled utensils are typically located adjacent to food preparation. The need for proper ware washing is required not only due to the location of such cleaning stations but also due to possible cross contamination when the wares are immediately placed back into service. For this reason, the cleaning stations become a primary area of concern when dealing with food related illnesses.

The CDC estimated that food borne diseases cause approximately 76 million illnesses, 325,000 hospitalizations, and 5,000 deaths in the United States each year. Known pathogens account for an estimated 14 million illnesses, 60,000 hospitalizations, and 1,800 deaths. Three pathogens, Salmonella, Listeria, and Toxoplasma are responsible for 1,500 deaths each year; more than 75% of those are caused by known pathogens, while unknown agents account for the remaining 62 million illnesses, 265,000 hospitalizations, and 3,200 deaths. More than 200 known diseases are transmitted through food. Surveillance of food borne illness is complicated by several factors. The first is underreporting, although food borne illnesses can be severe or even fatal, milder cases are often not detected through routine surveillance. Second, many pathogens transmitted through food are also spread through water or from person to person, thus obscuring the cause of food borne transmission. Finally, some proportion of food borne illness is caused by pathogens or agents that have not yet been identified and thus cannot be diagnosed. For instance, Listeria monocytogenes and Cyclospora cayetanensis were not recognized as caused of food borne illness just 20 years ago. (see CDC issue Vol. 5, No.5).

In February of 2008, ABC reported on an undercover investigation where it was shown that hotel drinking glasses were so dirty they could pose a serious risk to health. While Arizona health code requires that hotel drinking glasses be "cleaned and sanitized," using a dishwasher or three-compartment sink, three of the four hotels that ABC tested failed by not replacing dirty glasses with clean ones or using only a towel or sponge to wipe glasses before putting them back out for the next guest. Testing hotels from Kansas City to Cincinnati to Baltimore, 11 of the 15 hotels tested did not take dirty glasses out of the room for cleaning and sanitizing. (see ABC15 investigation report Feb. 12, 2008).

U.S. Pat. No. 4,872,466 and U.S. Pat. No. 4,810,306 disclose a commercial ware washer in which racks of soiled ware are consecutively washed through a machine cycle which includes recirculating wash water over the ware followed by a fresh water spray rinse. A portion of the wash water is drained and a second portion is intentionally retained in the machine during the rinse period after each rack of dishes is washed. The retained portion is thereby combined with the fresh rinse water to provide a volume of water sufficient for pumped wash recirculation for the next rack without cavitation, while enabling usage of a minimum quantity of rinse water required to provide effective rinsing. Reduced water consumption, reduced energy to heat the water and reduced chemical usage (detergents, sanitizers and rinse agents) are all possible in amounts and degrees depending upon the type and design of ware washer with which the method and apparatus is employed.

U.S. Pat. No. 4,439,242 discloses a low hot water volume ware washer. A rack-type high capacity ware washing machine is designed to cleanse and sanitize food ware in a cycle time of the order of one minute and to accomplish sanitizing by heating the food ware with fresh hot water sufficiently to kill residual bacteria thereon. The method of operation of the machine includes a final rinse period in which fresh water at a temperature of at least 180 DEG F. (82.22 DEG C.) is sprayed over the food ware to remove residual soil and to heat the food ware surfaces to at least 160 DEG F. (71.11 DEG C.), followed by a dwell period in which the wet heated food ware is maintained in a substantially closed humid atmosphere to prolong the time during which the food ware surfaces remain above bacteria killing temperature and to cause a build-up of Heat Unit Equivalents to at least 3600.

U.S. Pat. No. 5,660,194 discloses a wash water system for retrofitting a pre-wash tank or sink includes a plurality of spray nozzles which extend along an inner surface of a back wall of a pre-wash sink wherein the spray nozzles are in flow communication with a discharge side of a water circulating pump. A return conduit is provided wherein the return conduit extends vertically downward along the inner back wall of the sink a preselected distance and is in flow communication with a suction or intake side of said pump. The sink is provided with a bottom wall with at least one opening therein and a heater is provided with a conduit extending from the heater to and in flow communication with the opening in the bottom wall of the sink. A vertically extending first filter device is placed along the back wall of the sink over the openings into the return conduits to the suction side of the pump and a second filter device is placed over the opening in the bottom wall of the sink.

U.S. Pat. No. 4,277,290 discloses soiled food ware cleaned in a batch-type machine in which the food ware is subjected to a washing cycle and a chemical sanitizing rinsing cycle. A controlled flow of fresh preheated rinse water is supplied to an accumulation tank during the wash cycle while a drying agent is optionally added to the water in the tank. Thereafter, the rinse cycle is initiated by pumping the accumulated fresh water into a rinse line at a predetermined pressure to provide uniform flow in the rinse line. A liquid chemical sanitizing agent is then introduced directly into the uniform flow of water in the rinse line. This sequence of operations provides a desired uniform water pressure, independent of water supply pressure, for effective rinsing action and accurate metering of sanitizing agent into the uniform flow of water in the rinse line. Direct introduction of sanitizing agent into the rinse line minimizes contact time between the sanitizing agent and the fresh rinse water, which may contain a drying agent relatively incompatible with the sanitizing agent. Controlled flow of preheated rinse water into the accumulation tank during substantially the entire wash cycle minimizes the energy requirements of the system by reducing the heat losses in the machine.

U.S. Pat. No. 4,756,321 discloses a chemical dispenser and controller for industrial dishwashers. The level of detergent concentration in the dishwasher wash water is measured in logarithmically scaled unit, and the target detergent concentration level is specified in similar units. The dishwasher's controller converts wash water conductivity measurements into logarithmically scaled detergent concentration measurements. The unit of measurement for these logarithmically scaled measurements are called "Beta" units. The controller also monitors the detergent concentration level and generates an alarm if the measured detergent concentration fails to increase by at least a predefined amount while the detergent feeding mechanism is turned on. Another feature of the controller is that it generates an alarm if the measured detergent concentration fails to reach its target level after the detergent feeding mechanism has been on for a predetermined time period. Further, the controller includes different control strategies for conveyor and batch type dishwashers, including a control method for conserving rinse agent and detergent in batch type dishwashers.

U.S. Pat. No. 4,781,206 discloses a commercial ware washer that consecutively washes racks of soiled ware, such as dishes, through a machine cycle which includes recirculating wash water over the ware followed by a fresh water spray rinse. Part of the wash water is drained and a second portion is retained in the machine after each rack of dishes is washed, then combined with subsequent fresh rinse water spray to provide a volume of water sufficient for pumped wash recirculation for the next rack without cavitation. When a drain valve is opened, water pressure to the wash arm system is reduced, flow through it decreases, and when the pump stops the wash system will drain by gravity to the lowest point in the wash system plumbing. In the meantime the pump discharges wash water until the level of water in the sump and/or its associated outlet pipe reaches the level of the pump impeller eye. The pump begins to cavitate and effectively ceases to pump water.

U.S. Pat. No. 4,456,022 discloses a flatware apparatus that comprises a support platform, mechanical arrangements for mounting the platform, and respective washing and rinsing sprays. The platform is adapted to receive a cylindrical cup or holder for grouping a plurality of flatware pieces in a shock; and a drive arrangement is provided for causing rotation of the platform, or the cup or holder, so that the flatware pieces experience agitated movement. The wash spray is positioned to direct jets of washing and sanitizing fluid into the path of the churning flatware pieces. Mechanical arrangements are also provided for selectively lifting the flatware pieces in the cup in order to fully expose the food-contact surfaces thereof to the washing action.

U.S. Pat. No. 5,581,836 discloses a compact washing and sanitizing unit and method for cleaning and drying food service trays as well as other articles after being serially loaded in an upright manner in guide tracks that lead through the unit so that the trays process one at a time through adjacent washing and drying stations of the unit. After being manually loaded, an operator by exerting a displacement force on a last loaded tray urges preceding trays through the unit by virtue of their edge-to-edge physical contact.

U.S. Pat. No. 4,773,436 discloses Improvements in pot and pan washing machines (as opposed to dishwashing machines and drinking glass washing machines); a device adapted to receive large pots and pans used in cooking operations in a restaurant or the like which is downstream, typically, in the work process of cleaning pots and pans, from an initial scraping and scrapping tank, then, typically, is followed by a rinsing tank, the latter then followed by a sanitizer tank; a pot and pan washer tank utilizing a multiplicity of relatively high velocity, underwater, spaced apart water input jets on one wall thereof which provide a tank-wide circulating flow from upper back to lower front and then upwards and back within the tank from the front wall, the jet nozzles being positioned below the operating water level, there preferably being an overflow opening above the jet nozzles and pipes associated therewith, a pump circulating water from a lower portion of the tank at one side thereof to the noted jet nozzles, a faucet being preferably provided above said overflow opening for initially filling or refilling the tank and controlling the level of water therewithin for various purposes involved in the carrying out of the washing of the pots and pans; improvements in pot and pan washing devices where relatively unclean pots and pans from a scraping and scrapping tank or operation may be continuously fed into such device which continuously operates, the clean or more clean pots and pans, after an interval therewithin; continuously being removed from said tank to be passed to a rinsing step.

U.S. Pat. No. 6,021,788 discloses an apparatus that circulates and agitates a liquid cleansing solution in a sink by means of gas jet bubbles, in order to clean dirty articles therein. The basic device comprises a base structure, a pressurized gas supply, hollow jet nozzle means disposed in the sink, the jet nozzle means having a sealed end and a plurality of apertures thereon for gas ejection, so as to produce gas bubble jet streams which scrub and clean the articles by both article impact and agitation of the liquid cleansing solution. Preheating of the pressurized gas, coupled with a manifold heat exchanger in the cleansing solution, provides the means for heating the cleansing solution. Temperature control means are then used to maintain the temperature of the cleansing solution against cooling. Alternately, the heat source may include a separate liquid heater. The warmed gas may also be used to dry the articles after washing.

U.S. Pat. No. 5,939,974 relates to a system for monitoring and controlling food service requirements in a food service establishment. It includes a main computer with appropriate peripherals and an interface unit. The interface unit is connected to the main computer and is also connected to a plurality of monitoring devices, some of which monitor essential food establishment functions, such as temperatures, motion detectors, sanitary areas and the like, while others monitor employee activities. The interface unit is also connected to a plurality of control devices which both monitor and control essential activities, including sanitation, temperature, signals for smoke detection, pH levels, inventory and employee activities. Portable instruments are included with connection capabilities to the interface unit, and employee identification devices are also included.

U.S. Pat. No. 7,731,154 discloses optical sensors and methods for sensing optical radiation. The optical sensors and the optical sensing methods are used, for example, for controlling the operation of automatic faucets and flushers.

U.S. Pat. No. 7,989,780 discloses an ultraviolet (UV) fluorometric sensor that includes a controller, at least one UV light source and at least one UV detector for measuring a chemical concentration in a sample by measuring fluorescence of that sample. The controller calculates the concentration of the chemical in the sample based on the detected fluorescence emission.

U.S. Pat. No. 7,652,267 discloses an ultraviolet (UV) fluorometric sensor that measures a chemical concentration in a sample based on the measured fluorescence of the sample. The sensor includes a controller, at least one UV light source, and at least one UV detector. The UV detector measures the fluorescence emission from the sample and the controller transforms output signals from the UV detector into fluorescence values or optical densities for one or move wavelengths in the wavelength range of 265-340 nm. The controller calculates the chemical concentration of the chemical in the sample based on the measured fluorescence emissions.

U.S. Pat. No. 7,372,039 discloses a UV absorption spectrometer that includes a housing, a controller, and a sensor unit including an ultraviolet light source, an analytical area in an analytical cell or in running water or gaseous medium, and an UV wavelength separator including a UV detector. An ultraviolet light in a wavelength range of 200-320 nm emits from the light source through the analytical area to the wavelength separator, and a controller transforms output signals from the UV detector into absorbance values or optical densities for two or more wavelengths in the wavelength range, calculates differences of absorbance values or optical densities, determines a concentration of a chemical in the solution with calibration constants found for a known concentration of the chemical and the differences of the absorbance values or optical densities.

SUMMARY OF THE INVENTION

Disclosed is a method and apparatus to control ware washing to provide and maintain health safety through the use of an automated system. The method and apparatus provides consistently clean, high detergent, water and sanitizer levels, at its proper temperature, which are maintained to ensure the removal of all human DNA, oils and other food waste that could, when not properly removed after the sanitize cycle process, forms a bacterial growth on the kitchen cooking equipment, glasses, cups, plates and utensils, contaminating future food or liquid use.

An objective of the invention is to provide and maintain health safety through the use of an automated system for a three-bay commercial kitchen sink where the system is consistently adhering and maintaining FDA/EPA standards for clean, high sanitizer and detergent water levels, at its proper temperature to ensure the removal of all oils and other food waste that could, when not properly removed after completing the three stage process, form a bacterial growth on the kitchen cooking equipment, glasses, plates and utensils, contaminating future food or drink use. It will also allow removal of human DNA that may or may not carry harmful diseases and be passed on to future customers.

Another objective of the invention is to eliminate food contamination caused by a dishwasher not manually changing the contaminated, low detergent, low sanitizer and low temperature sink water.

Still another objective of the invention is to eliminate the risk of not passing surprise/spot FDA/EPA inspections and resulting fines.

Yet another objective of the invention is to eliminate the fear of bad publicity, lost business and catastrophic business failure.

A final objective of the invention is to provide peace of mind provided by the assurance of clean dishwashing water and ultimately a more sanitary environment. Reduce the fear of lawsuits stemming from customers falling ill would be reduced.

The method and apparatus can be used for Dine-in Restaurants, Fast-food Establishments, Bars, Food Service Companies, Grocery Stores, Delis, Hospitals, Schools and Cafeterias; literally any establishment having a three-compartment commercial kitchen sink would utilize the invention.

Other objectives and advantages of this invention will become apparent from the following description taken in conjunction with any accompanying drawings wherein set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 18:
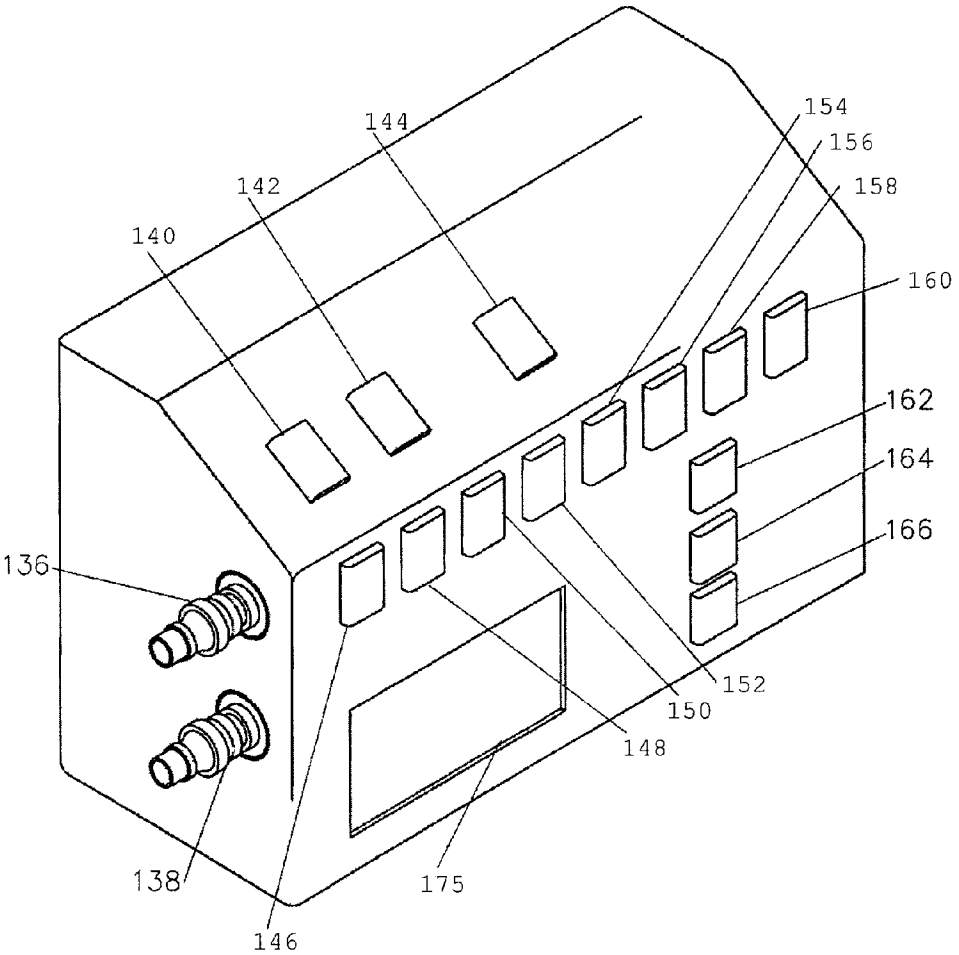
FIG. 18 is a front perspective view of the wall mountable control panel with LCD readable command panel.

Referring to FIGS. 1-20 of the drawings, a fully automated unit that drains and fills a three-compartment commercial kitchen sink bay to correct water levels, water temperature, and detergent/sanitizer levels. Through the use of sensors and light, the controller unit 10 (FIG. 18) analyses sink water quality to ensure compliance with required FDA/EPA standards and automatically drains and fills the sinks to maintain the correct water temperature and chemicals levels.

Figure 1:
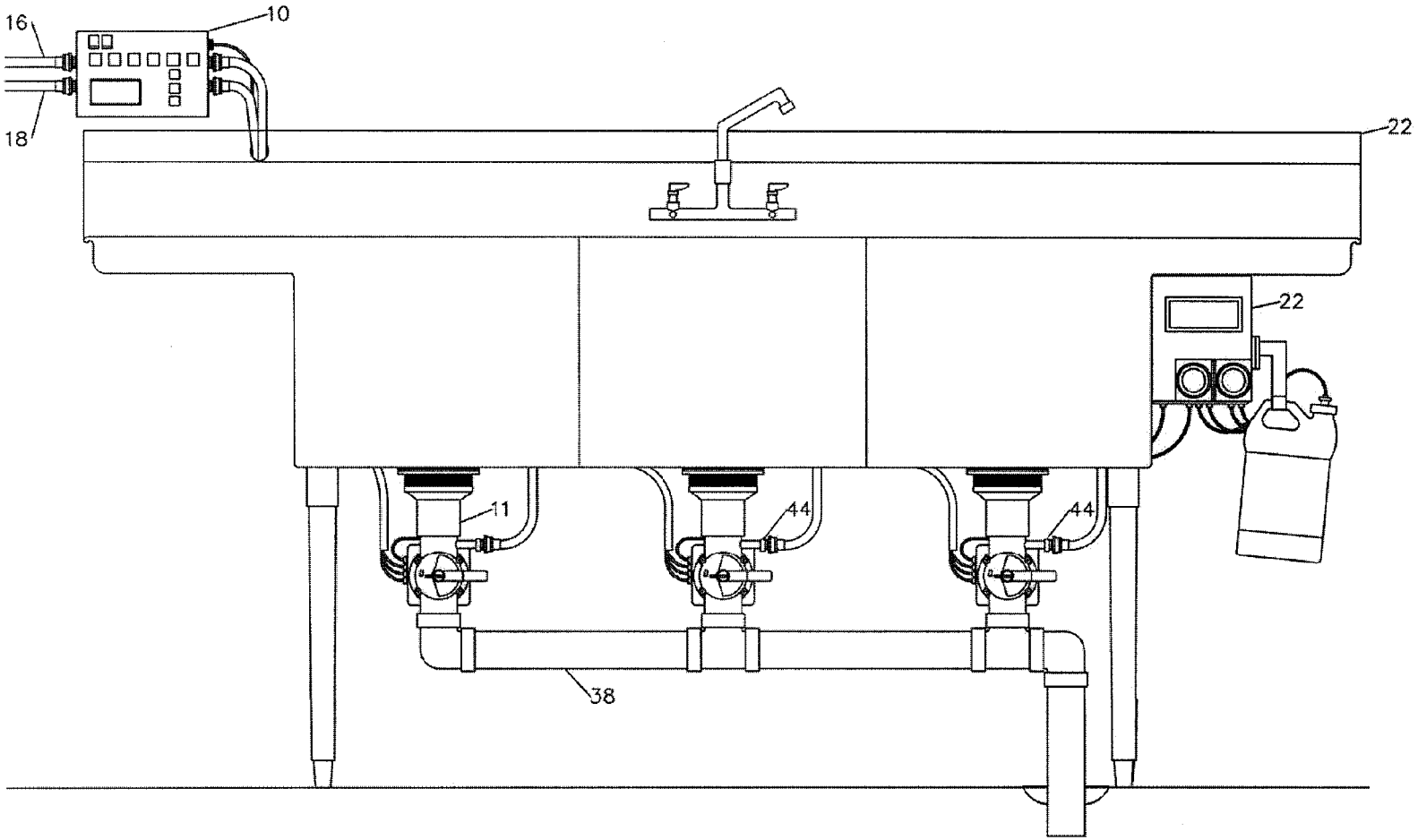
FIG. 1 is a front view of the control panel coupled to the drain of the main sink together with various sensors and detergent/sanitizer pump.
Figure 2:
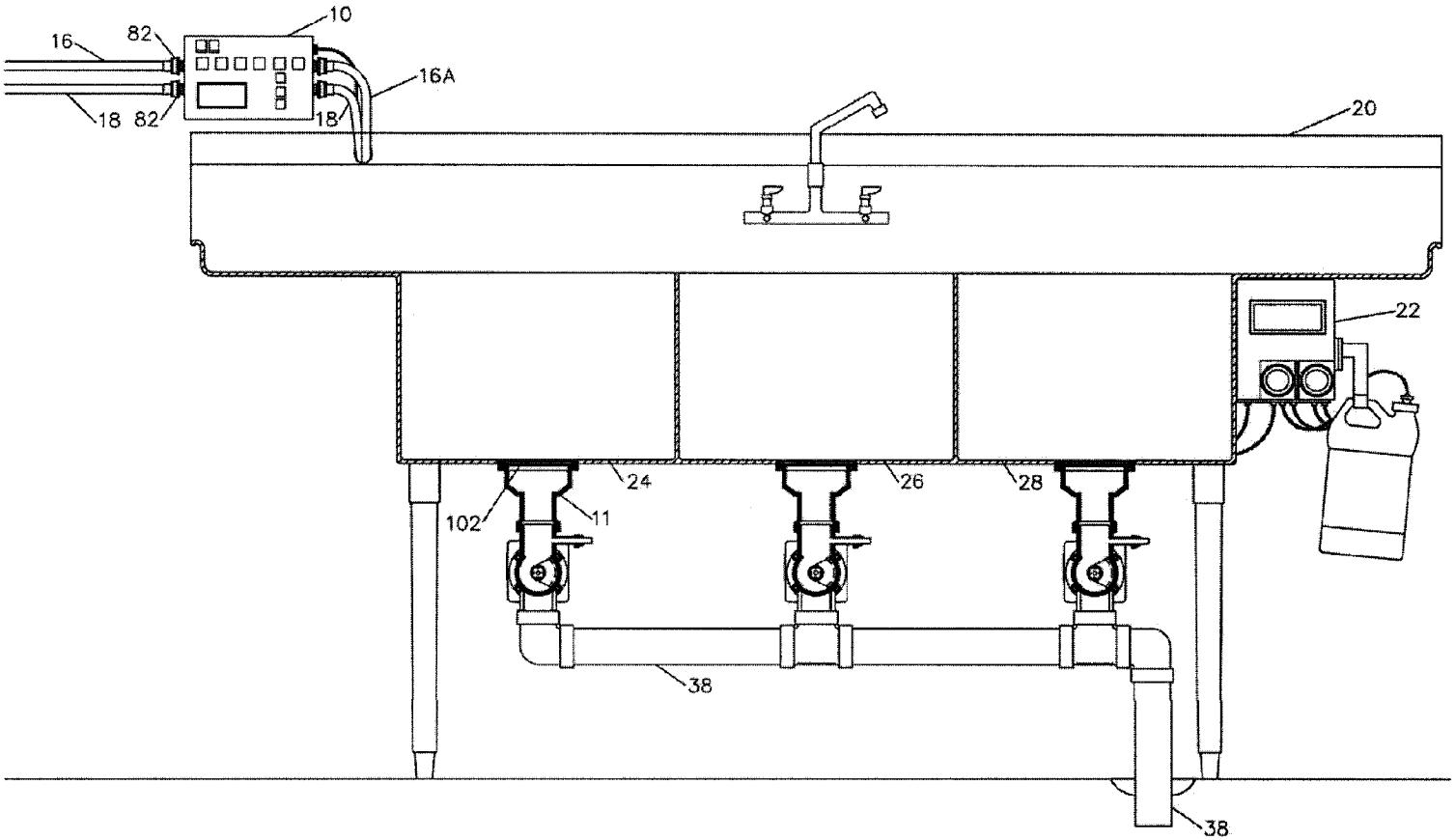
FIG. 2 is a front view of the various sinks commonly used and the particular action to be taken within each sink.

The device fits new or existing three compartment commercial sinks 20 (wash 24; rinse 26; sanitize 28), as illustrated in FIGS. 1 and 2. A soap detergent/sanitizer dispensing unit 22 may mount to the sink 20 or a wall for providing sanitizer and soap detergent to the designated sink bays. Each compartment has a sink drain 102 that is constructed to contain a drain opening 42 of a corresponding drain unit 11 thereby allowing for a fluid flow of water and contaminants to pass from the sink into the drain unit 11. The drain unit 11 connects to the drain line 38 providing a path for fluid discharge of water and contaminants.

The drain unit 11 has a water inlet 44 (FIGS. 3, 4 and 6) capable of receiving clean water. The water inlet 44 is connected to a water line 45 (FIGS. 11-13), the water line supplies water to both the drain unit 11 and to supply the sink 20. The water inlet 44 and the water line 45 are coupled with a quick connect member 82 (FIGS. 11 and 15B) for quick attachment or detachment. Further, a check valve 100 (FIG. 12) exists between the water inlet 44 and the waterline which prevents back flow passing back into the fresh water line 45 from the water inlet 44 preventing the contamination of fresh water.

Three drain units 11 are coupled to a system for discharging soiled water found in the sink. The units 11 are each capable of working independent of the other drain units.

Figure 3:
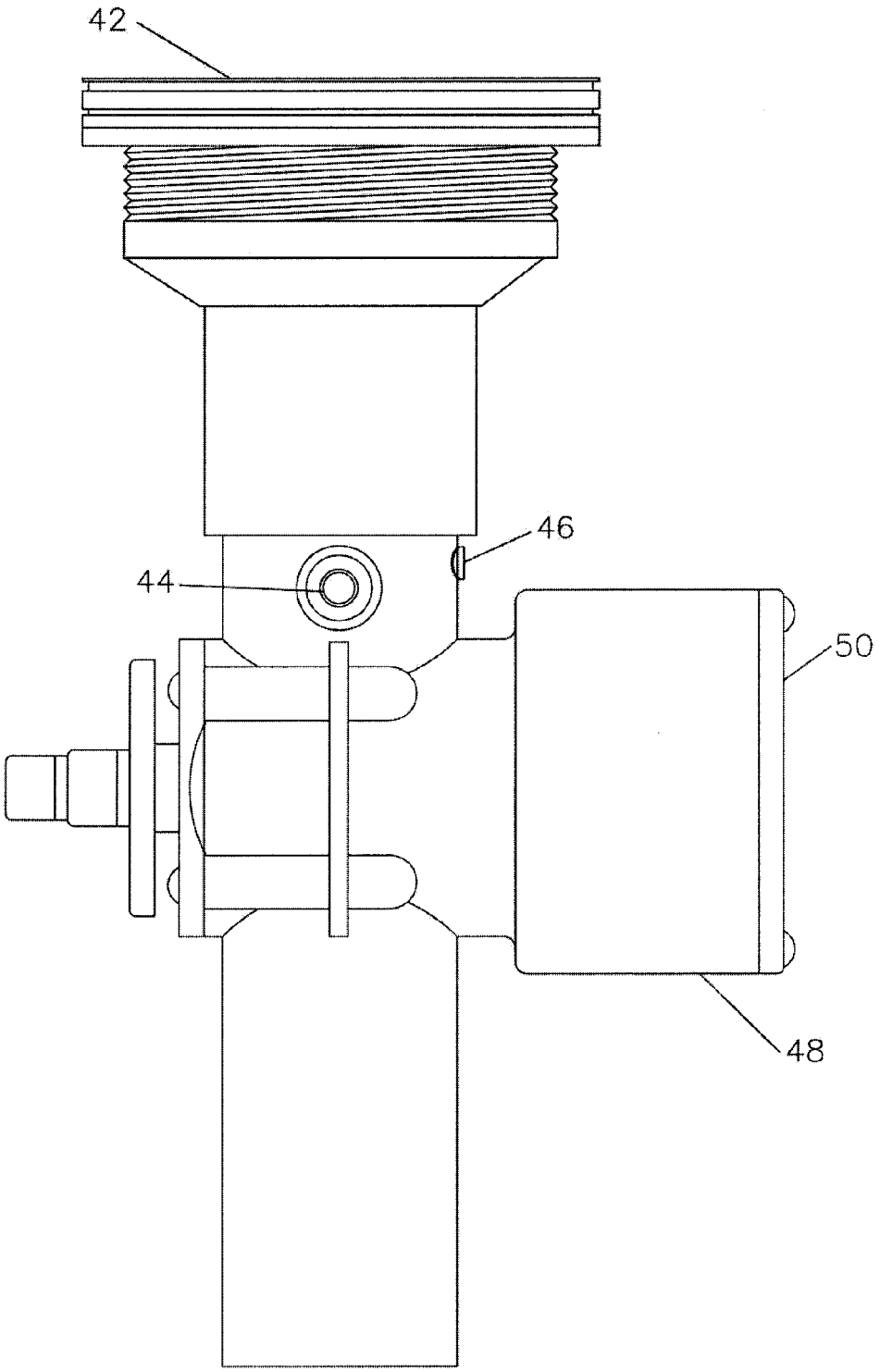
FIG. 3 is a side view taken along line A-A in FIG. 7 of the drainage component.
Figure 4:
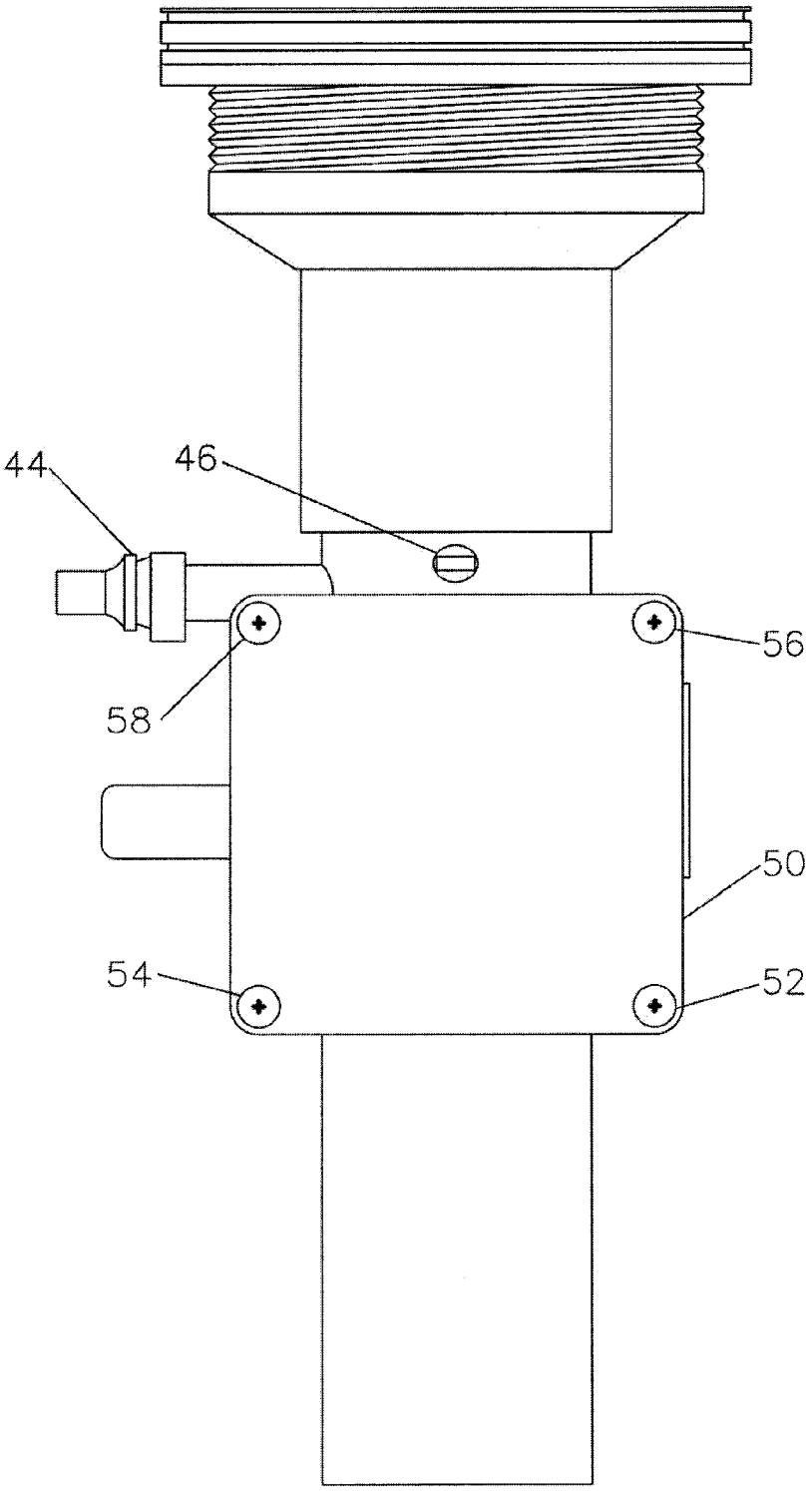
FIG. 4 is a side view taken along line B-B in FIG. 7 of the drainage component.

Referring now to FIGS. 3 and 4, each drain unit includes a circuit board motor housing 48. The housing 48 includes a housing cover access plate 50 with four securing members 52, 54, 56, and 58, the four members securing the plate 50 to the housing 48. The housing 48 includes a plurality of computer cable ports disposed about the body of the housing 48. In particular, the ports include a wet sensor port 60 (FIG. 5) which is coupled with cable 106 (FIG. 15A) to the wet sensor 46, a data port 62, a detection wand port 64 and a light sensor port 66 (FIG. 5).

Figure 5:
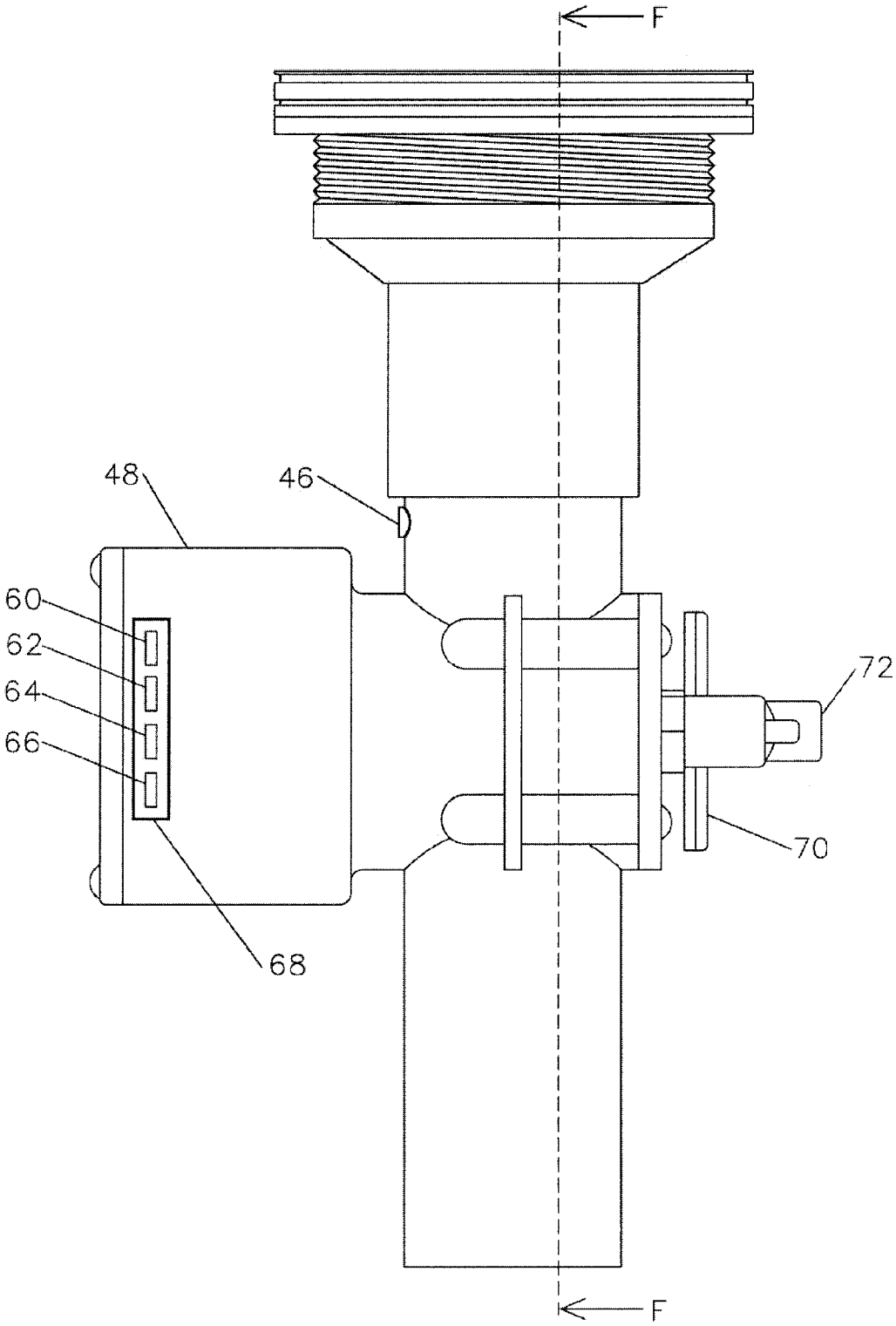
FIG. 5 is a side view taken along line C-C in FIG. 7 of the drainage component.
Figure 6:
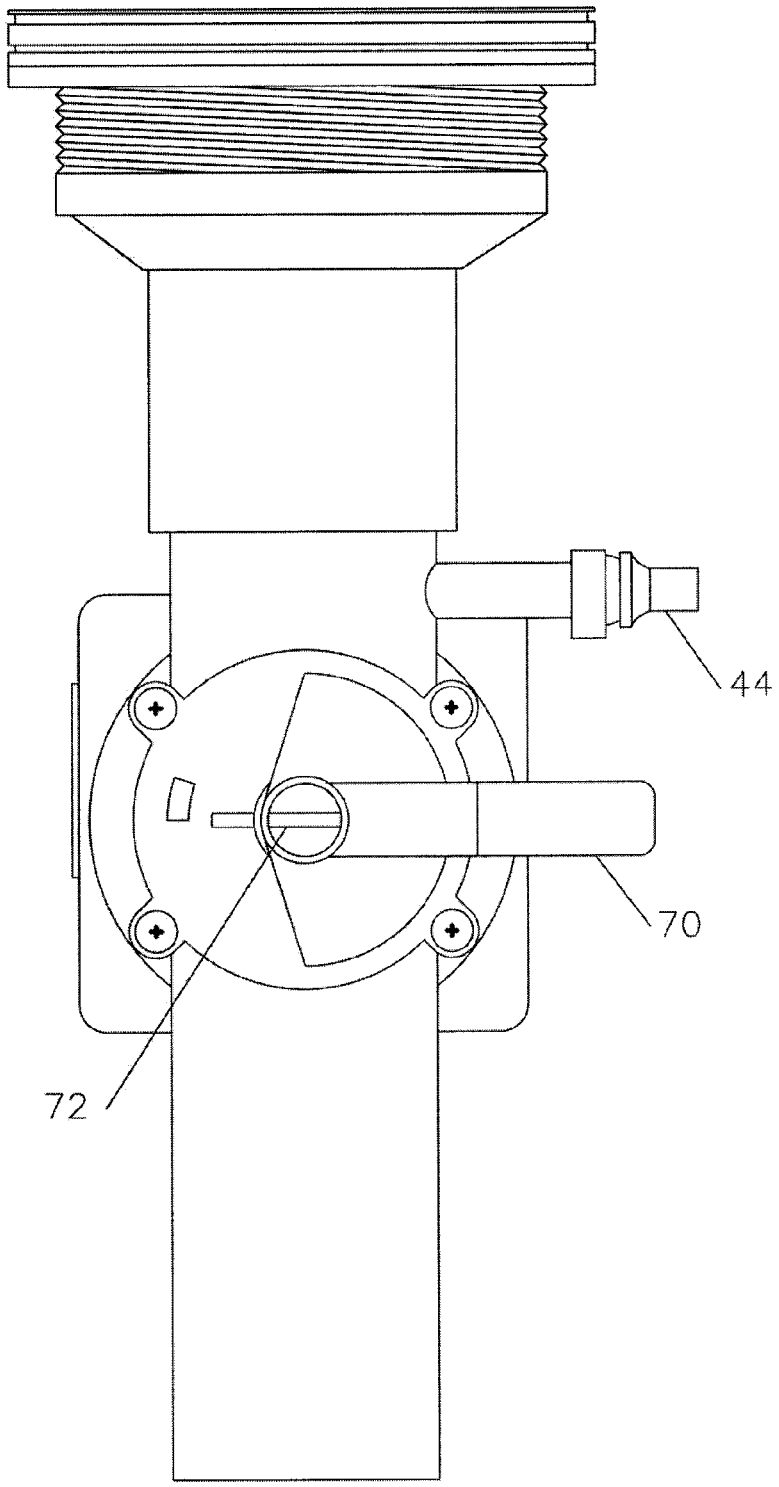
FIG. 6 is a side view taken along line D-D in FIG. 7 of the drainage component.
Figure 7:
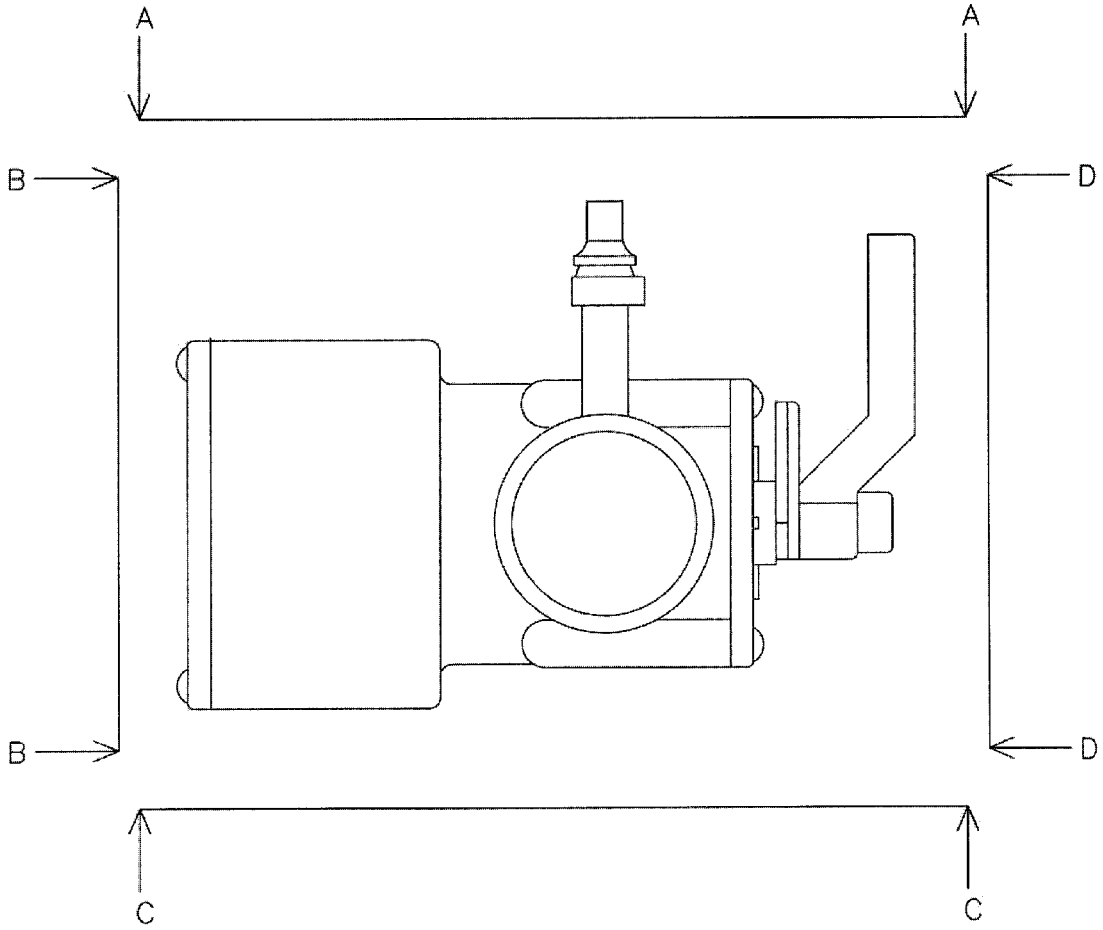
FIG. 7 is a top view of the drainage component illustrating the orientation of sides.
Figure 8:
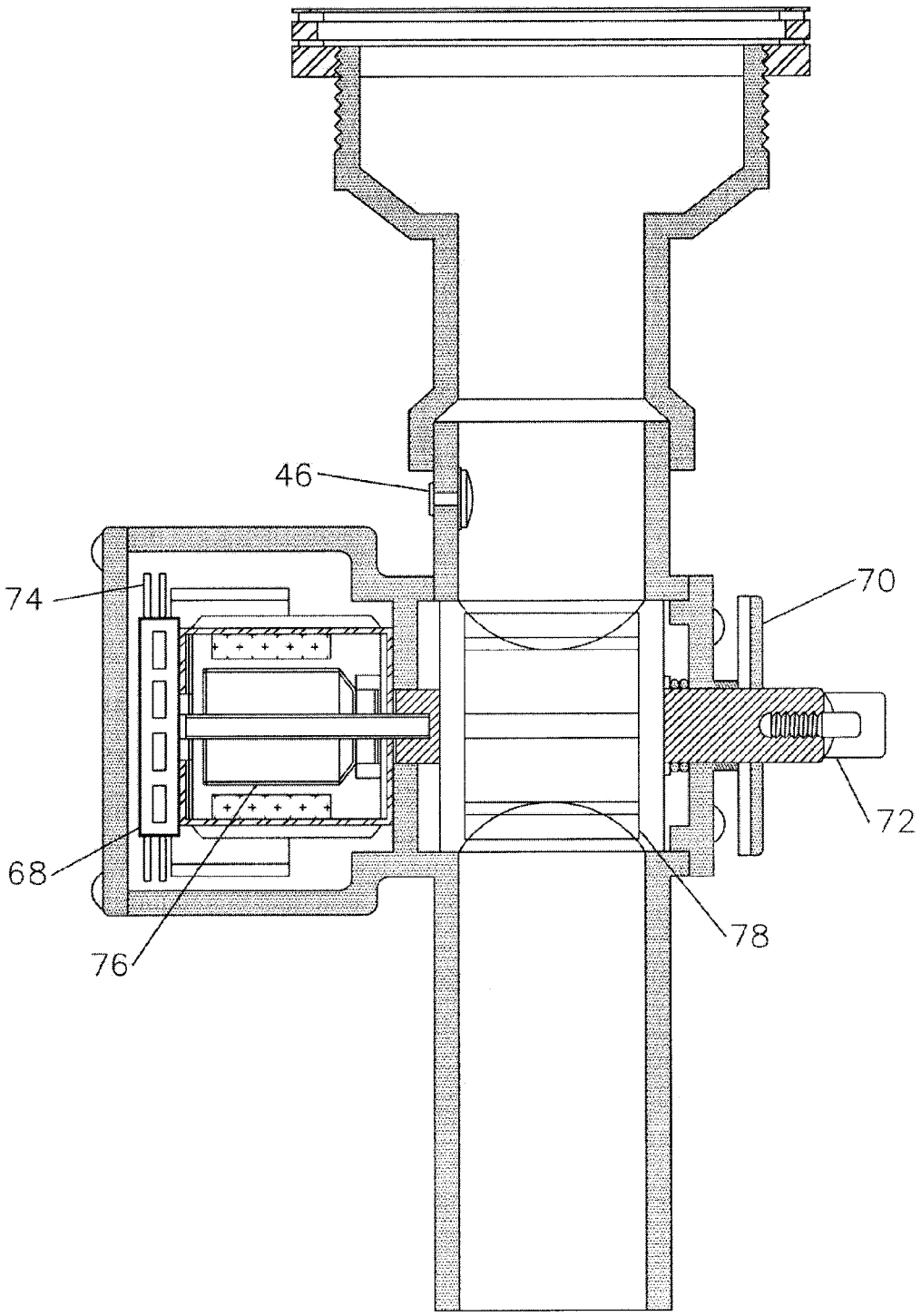
FIG. 8 is a cross-section of the drainage component side taken along line E-E of FIG. 6.
Figure 9:
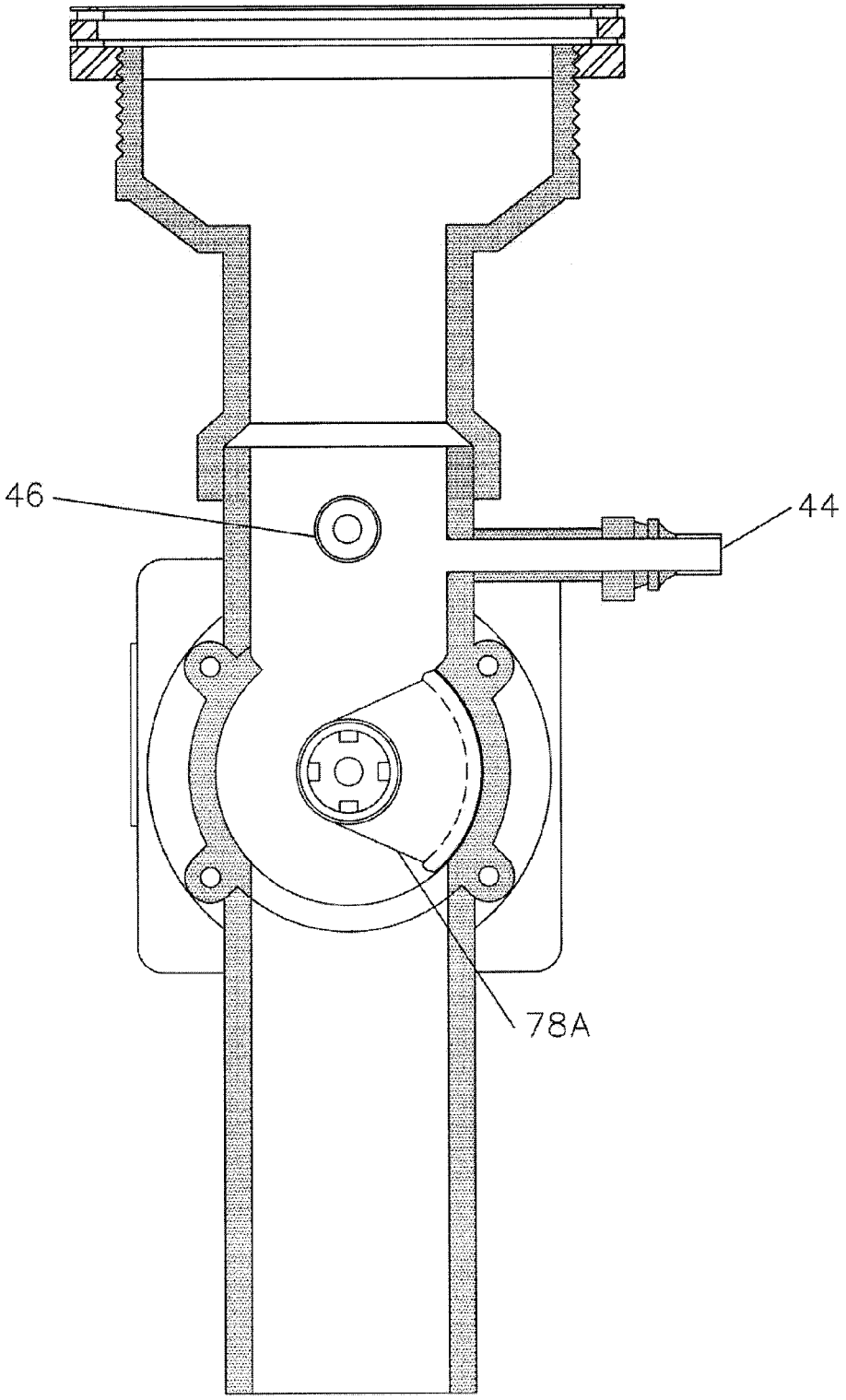
FIG. 9 is a cross-section taken along line F-F of FIG. 5 when diverter is open.
Figure 10:
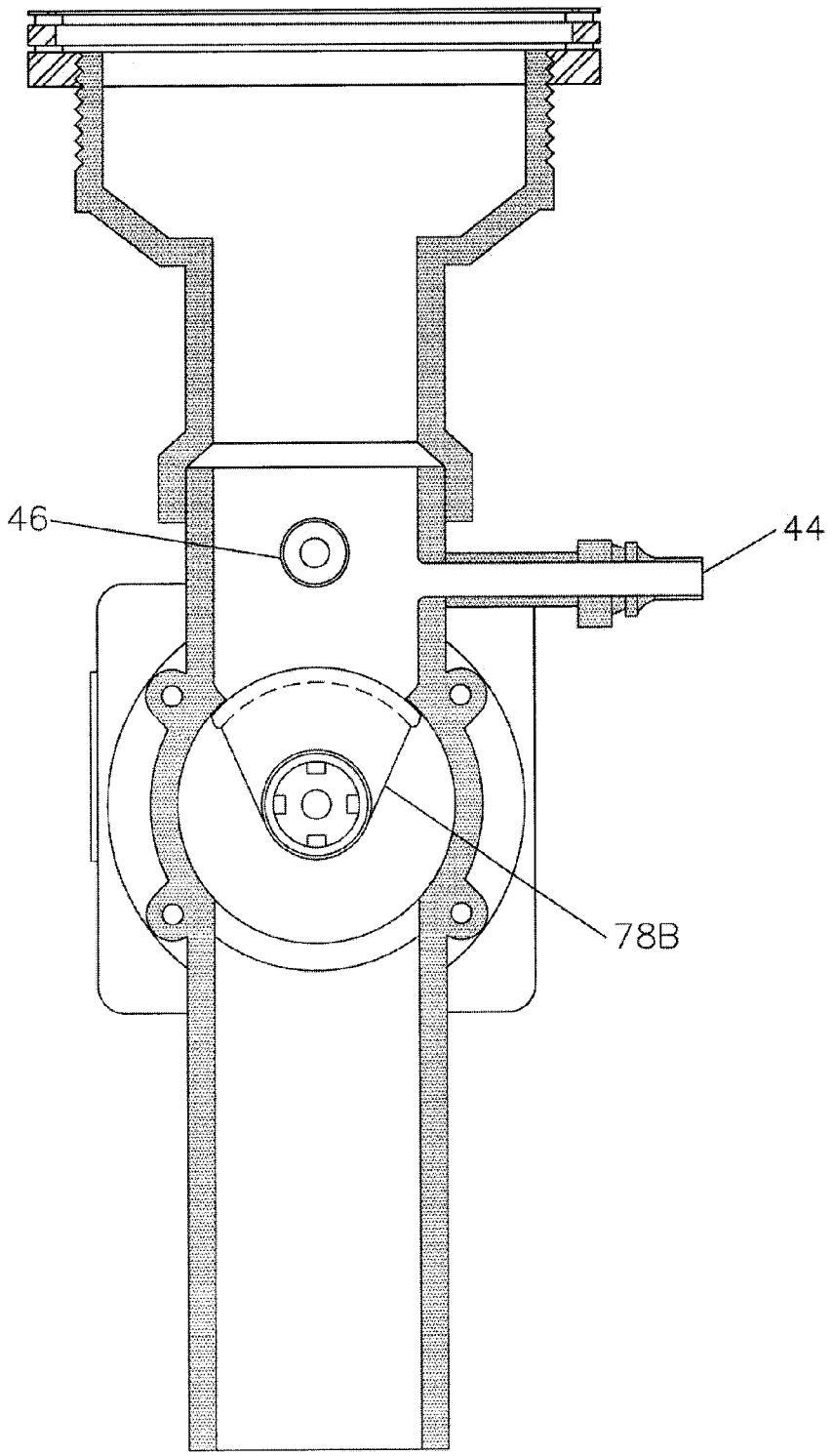
FIG. 10 is a cross-section taken along line F-F of FIG. 5 when diverter is closed.

Referring now to FIGS. 5 and 6, the discharge system additionally includes a lever 70 for manual operation of a diverter 78A and 78B (FIGS. 9 and 10). A twist screw 72 secures to the discharge system, the body of the screw passes through the lever 70, securing the lever 70 to the discharge system. The housing 48 contains driving member 76 that may reciprocate diverter 78 between an open and closed position (FIGS. 8-10). The diverter 78 may be driven electrically, hydraulically or pneumatically by the driving member 76. The housing further contains a circuit board 74 for electrical connection to the cable ports 68 and the motor 76.

The rotating diverter may sit in an open position 78A (FIG. 9) or a closed position 78B (FIG. 10). The open position 78A provides a means for fluid and contaminants to discharge from the sink 20 through the discharge system, down through the main drain 38 (FIG. 2) and into the sewer system. The wet sensor 46 will send a signal once the sink is empty back to the computer to close diverter 78B. The closed position 78B blocks the discharge of fluid and contaminants from passing form the sink 20 into the sewer system.

Figure 12:
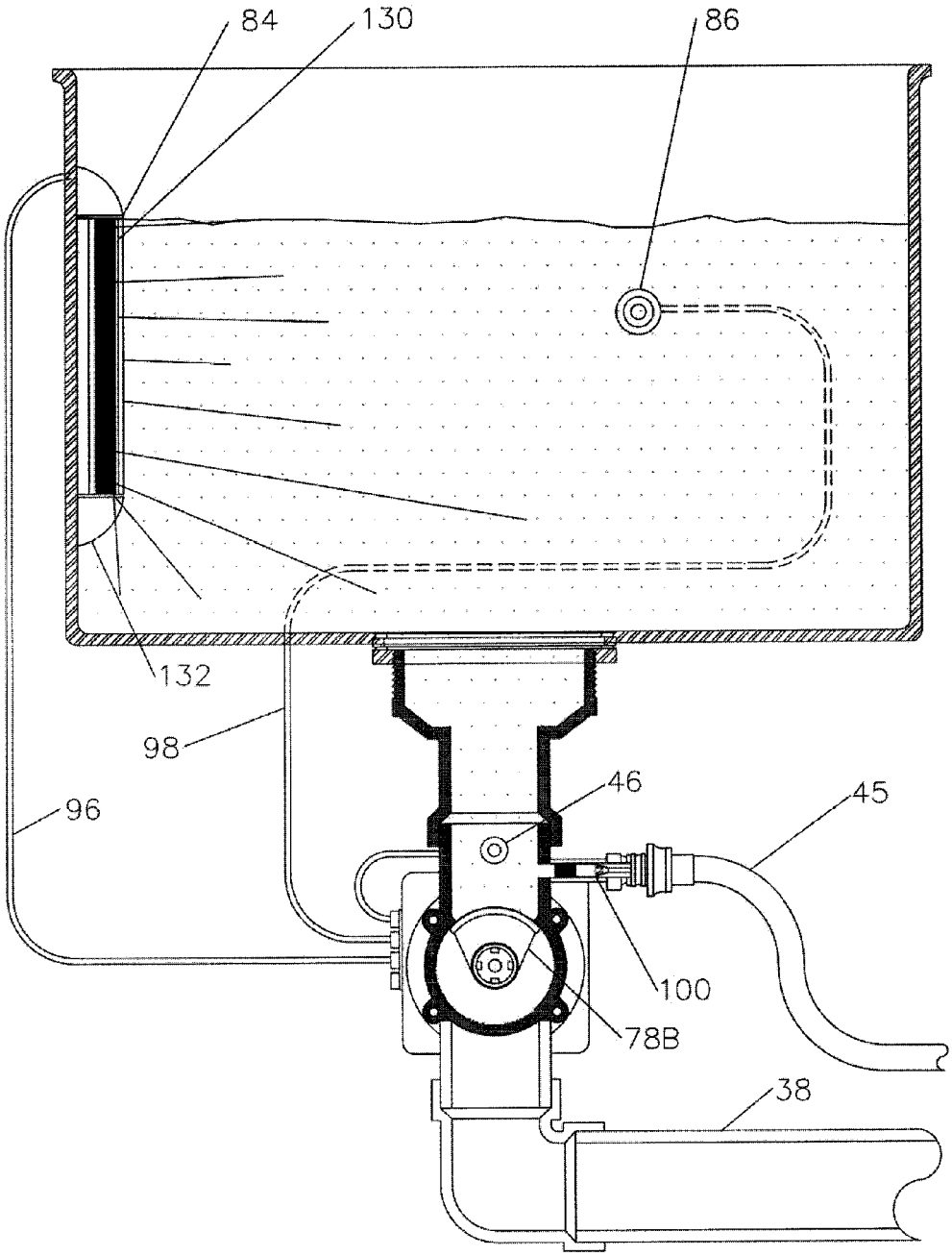
FIG. 12 is an illustration of a light illuminating the water so the sensor can read the water quality.

When the diverter is in the closed position 78B, water may enter the sink 20 through the water inlet 44 causing the water level in the sink 20 to rise and will stop once it reaches the water level sensor 84 (FIG. 12). The wash sink 24 and the rinse sink 26 accept hot water entering from a water inlet 44. The sanitized sink 28 accepts cold water entering from the water inlet 44.

In all three portions of the sink, the entering water continues to fill the sink 20 until a water level sensor 84 electrically signals the controller unit 10, wherein the controller unit 10 will turn off the flow of water into the sink. Each sink bay may fill and empty without regard to the other bays in order to manage the quality of the water found in the individual sections 24, 26, and 28.

As the sanitizing bay 28 fills with water, a sanitizer port 90 (FIG. 11) found about the body of that sink bay 28 will electronically disburse sanitizer.

Figure 11:
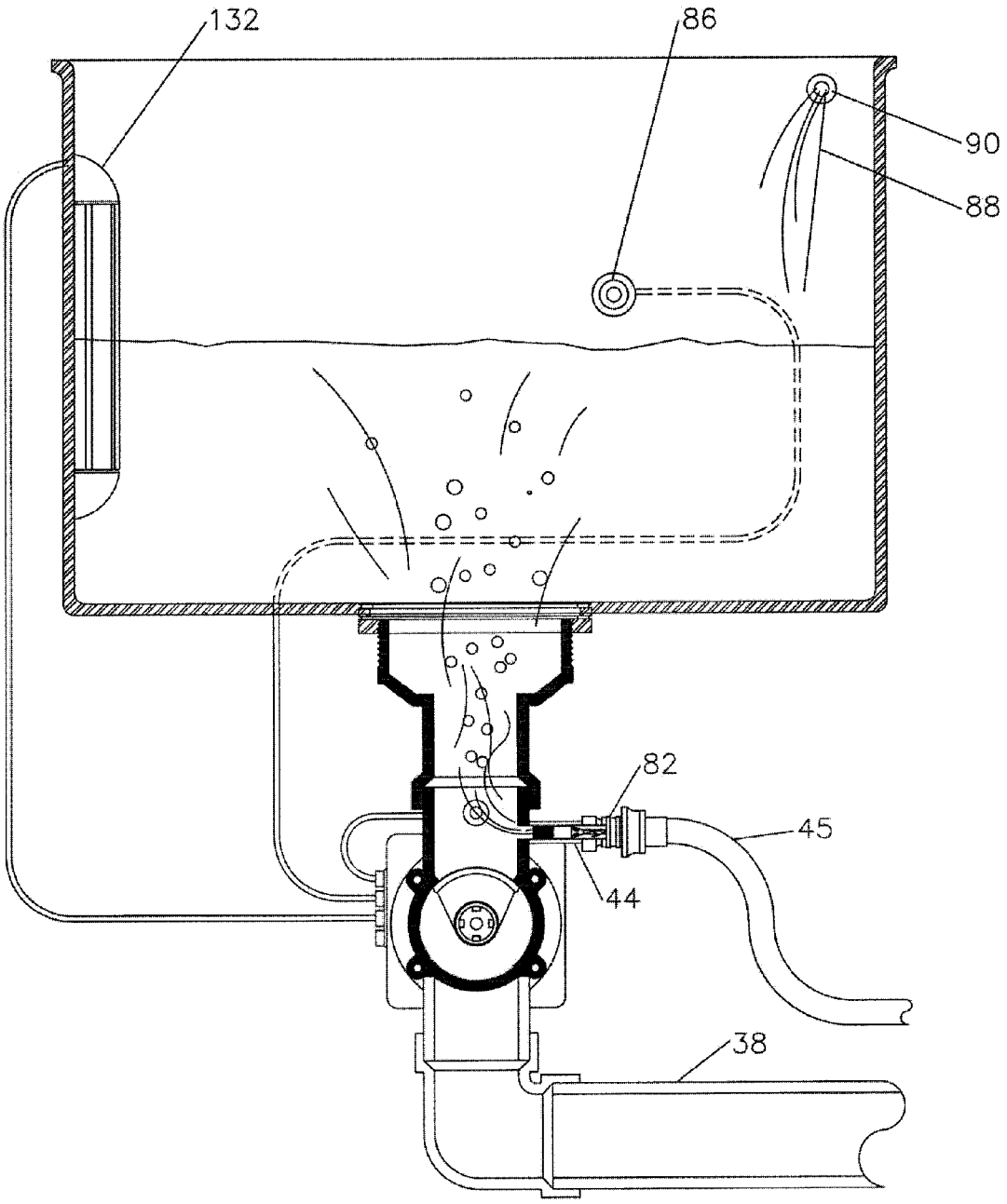
FIG. 11 is an illustration of the water fill action.
Figure 13:
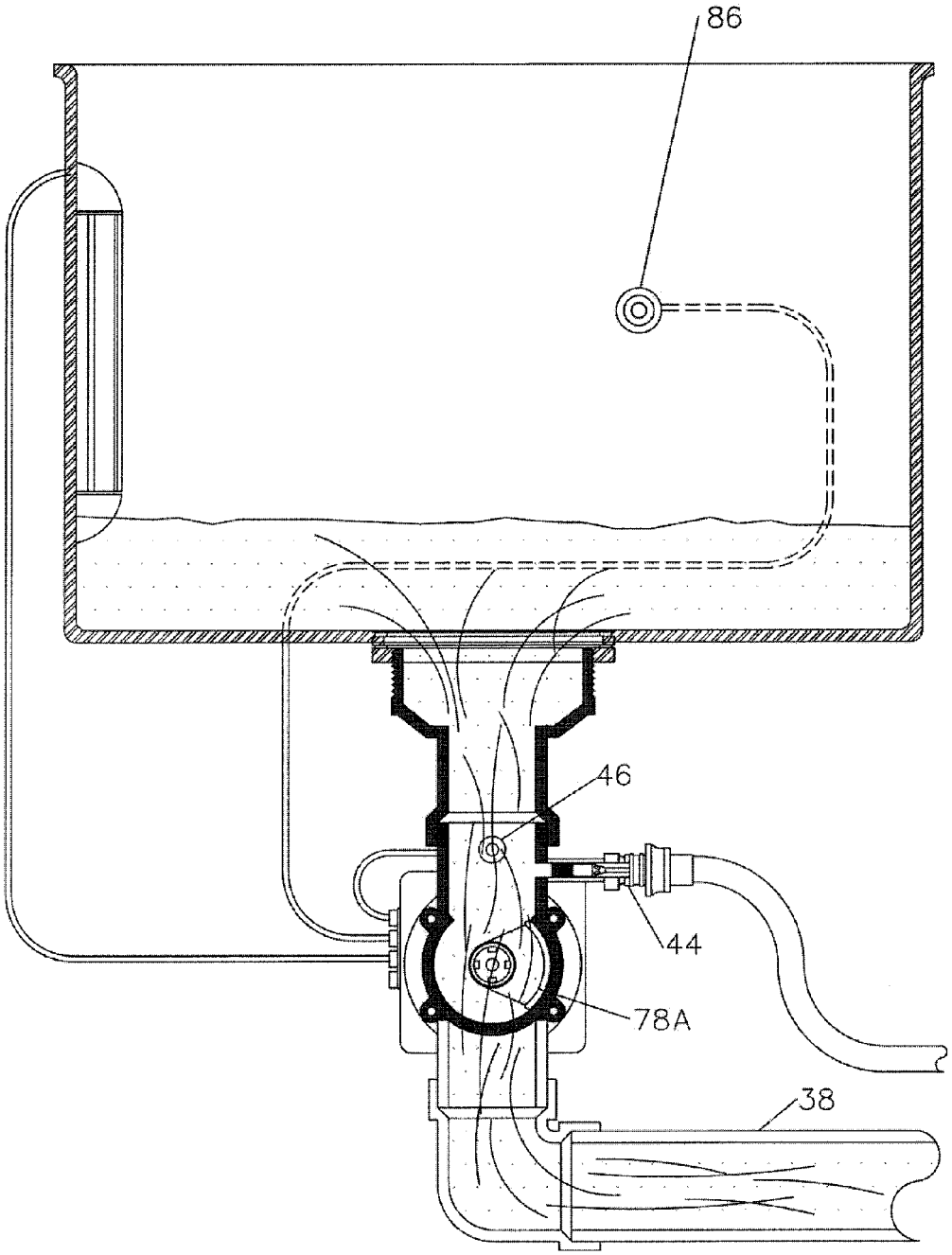
FIG. 13 is an illustration of where the light sensor, ph probe, and thermometer detected poor water quality, low detergent/sanitizer levels or low water temperature levels and electronically opened the diverter to allow the sink to drain.
Figure 14:
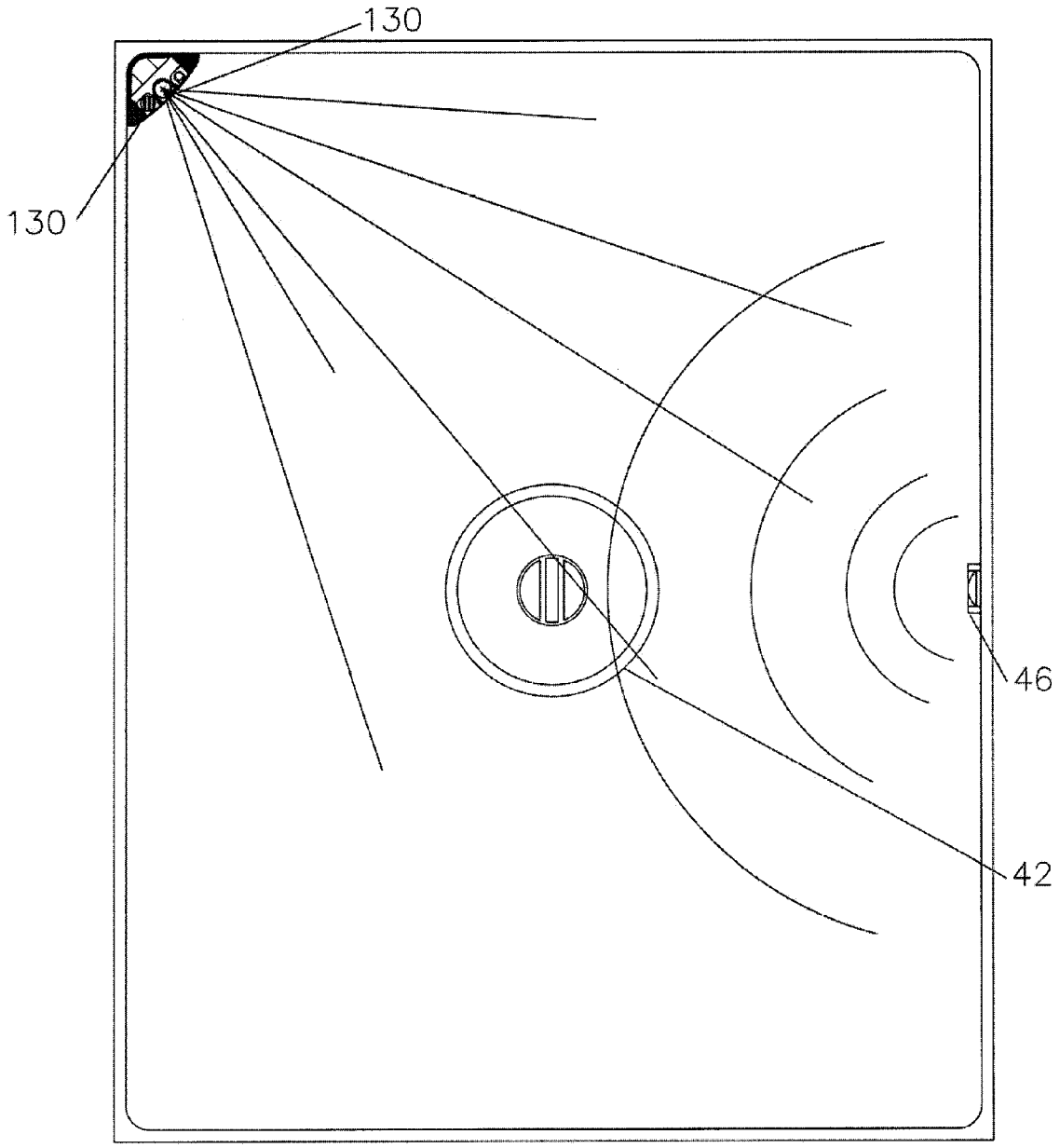
FIG. 14 is a top view of a sink bay in FIG. 1.

Sensors is placed on the inside of the sanitize 28 and rinse 26 sink compartments, as illustrated in FIG. 11-13. The sensors 86 may be capable of detecting light levels, waves or both.

The sink light 130 (FIGS. 16-17B) which is concealed in a metal or plastic housing, and Sensors that is mounted on the side wall of the sink bay monitors the concentration of a killing agent, namely quaternary ammonium, and the thermometer 128 monitors the water temperature, and when they fall below FDA/EPA required levels, a signal is relayed automatically to drain the sink basin, and refill it with cold clean water with the necessary amount of sanitizing solution.

The wash sink pH probe 122 (FIG. 16) monitors the concentration of pH and alkalinity in the detergent and the thermometer 128 which are both concealed in a metal or plastic housing monitors the water temperature, and when it falls below FDA/EPA required levels, sends a signal to automatically drain the sink basin and refill it with hot, clean water with the necessary amount of detergent.

The sink light 130, and thermometer 128 which are both concealed in a water tight metal or plastic housing. The sink light 130, thermometer and sensor 86 together monitor the turbidity and the water temperature and when it falls below FDA/EPA required levels, sends a signal to automatically drain the sink basin, and refill it with hot clean water. There are three thermometers 128 located in each sink bay 24, 26, 28 and one PH probe 122 located in wash bay 24 and two lights 130, one located in the rinse bay 26 to measure turbidity and one in the sanitize bay 28 to measure the quaternary ammonium level. The three thermometers 128, one PH probe 122 and two lights 130 are all encased in a plastic or metal housing for protection and proper positioning as they are submerged in the sink water.

The system has two lights mounted in the detection wand 132, one located in the rinse bay and one in the sanitize bay and performing similarly. The light in the rinse bay passes through the water contained in a sink bay. The light luminance is detectable by a sensor 86. As the water spoils from the rinsing of cooking equipment, glasses, cups, plates and utensils, etc., the detectable luminance about the sink bay becomes diminished. Once that luminance is diminished to a predetermined point, the sensor 86 will electronically signal the controller unit 10 allowing the valve diverter 78 to electronically open for water to drain. The sink light 130 illuminates the chemical compound and sensor 86 detects if the quaternary ammonium level is low and once it falls below the FDA/EPA standards, sensor 86 will electronically signal the computer unit 10 allowing the valve diverter to electronically open for water to drain.

A light sensor cable 98 (FIG. 12) having a first end and a second end is electrically coupled on the first end to the sensor 86 and on the second end to a cable port 68 (FIG. 5). The cable port 68 is additionally coupled to the controller unit 10 through data cable 112.

Figure 16:
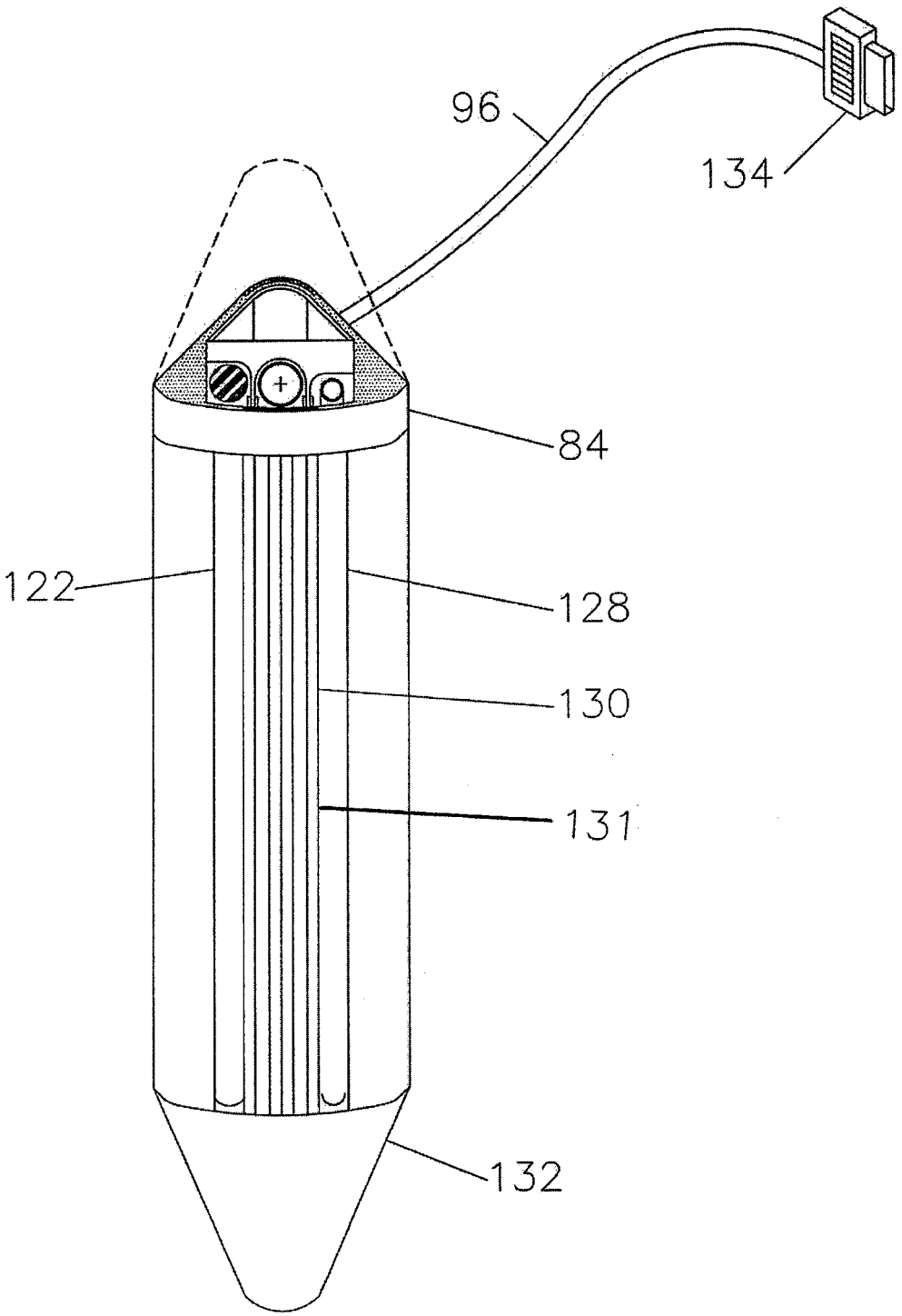
FIG. 16 is a front view of the detection wand 132.
Figure 17A:
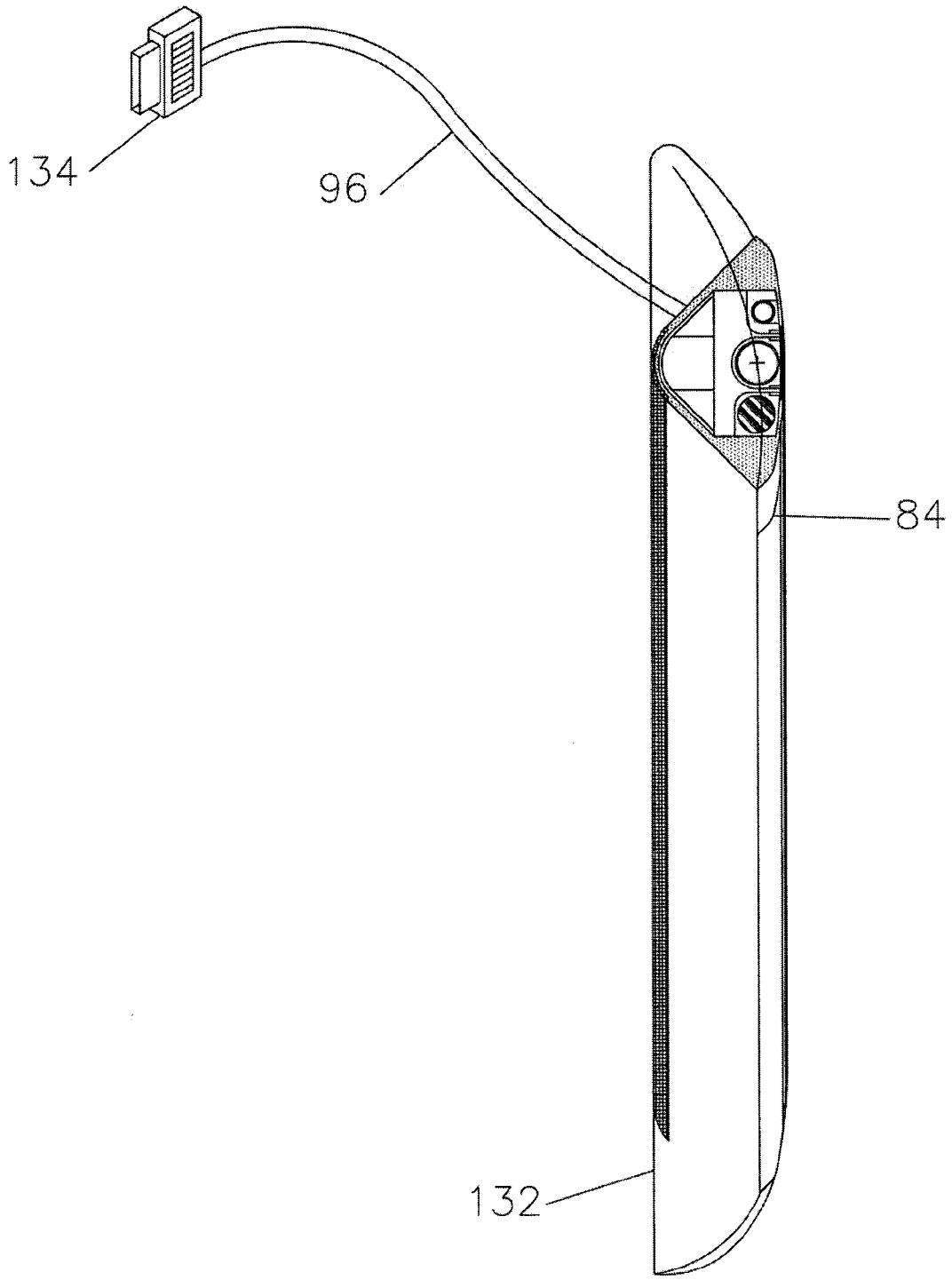
FIG. 17A is a cross-sectional view of the detection wand 132 taken along line G-G of FIG. 16.
Figure 17B:
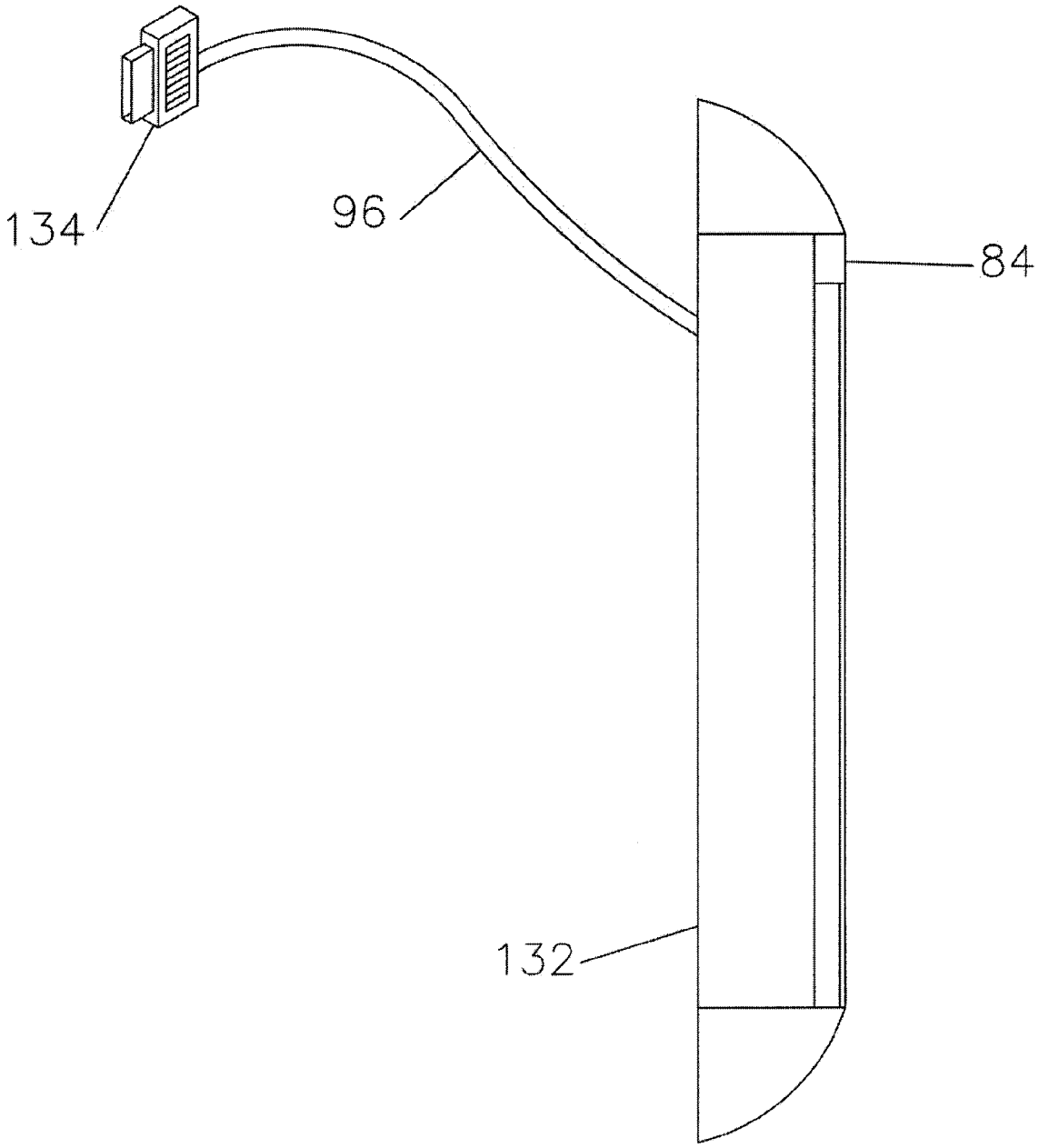
FIG. 17B is a side view of the detection wand 132.

A detection wand cable 96 (FIG. 12) having a first end and a second end is electrically coupled on the first end to a detection wand 132 and on the second end to the cable port 68 and connects with a port connection 134 (FIG. 16). A signal is then relayed back to the controller unit 10 through data cable 112.

Figure 15A:
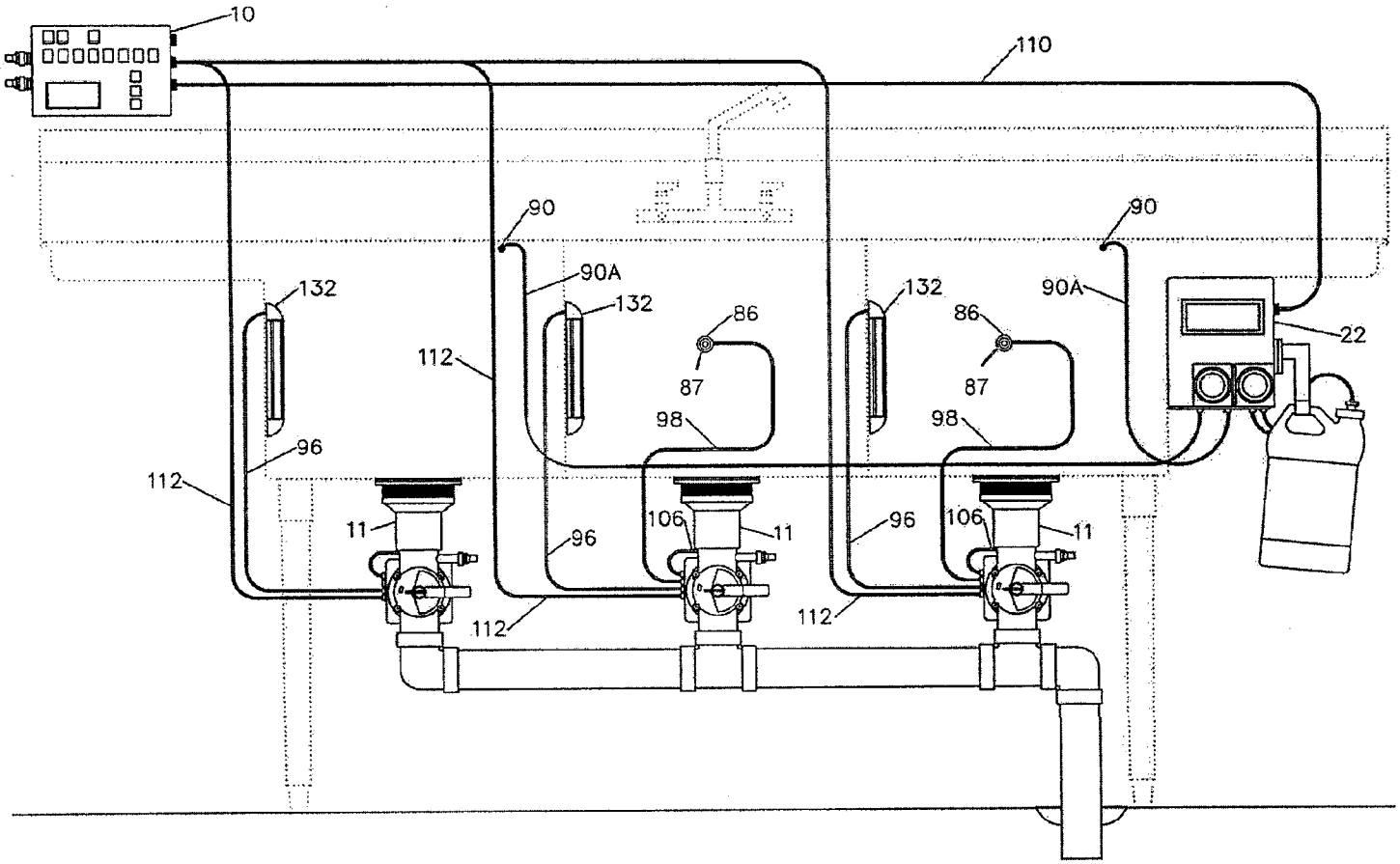
FIG. 15A is a view of the control panel coupled to the drain of the main sink together with various sensors and chemical supply lines.
Figure 15B:
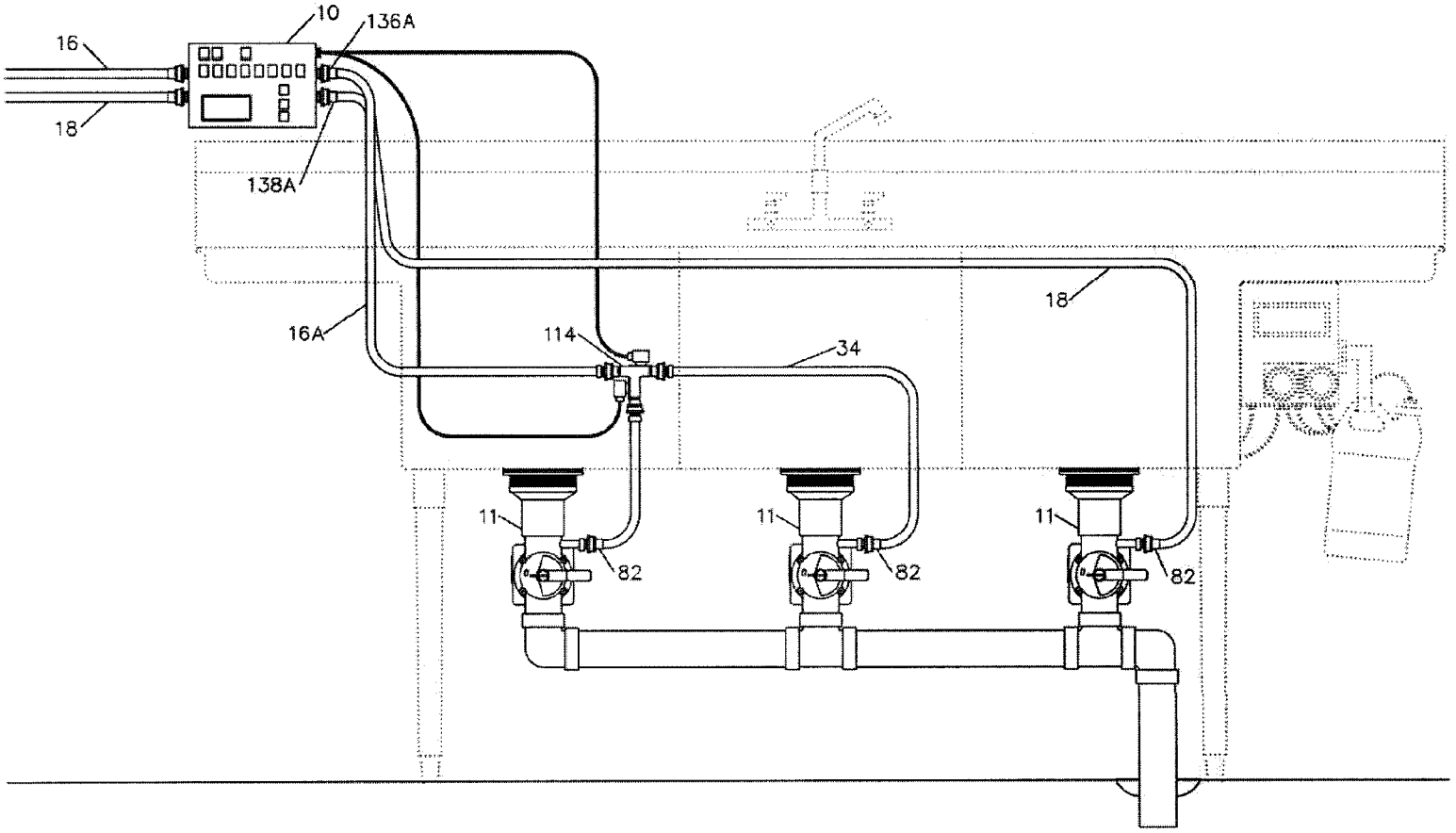
FIG. 15B is a view of the control panel coupled to the drain of the main sink together with various sensors focusing on the water lines.

Referring now to FIG. 15B, a hot water line 16 enters the wall mounted controller unit 10. The hot water line 16A includes a first end 136A and is mechanically coupled on its second end 136B to a tee connection 114. The tee connection 114 allows water from the hot water line 16*a* to two water inlet lines 116 and 118. The first water inlet line 116 supplies water to the wash sink 24 whereas the second water inlet line 118 supplies water to the rinse sink 26. Two solenoid diverter valves located about the tee connection 114 allow the wash sink and the rinse sink to fill as needed. In one method of operation, only one solenoid may be open at any moment in time. In another method of operation, the two solenoids may operate as follows:

| | Solenoid 1 | Solenoid 2 |
|---|---|---|
| 1 | Open | Open |
| 2 | Open | Closed |
| 3 | Closed | Open |
| 4 | Closed | Closed |

A cold water line 18 enters the wall mounted controller unit 10. Output coldwater line 138A is mechanically coupled on its first end to a cold water line 18 and on its second end to a water inlet 44.

A controller unit 10 controls the various systems. The computer unit has an LCD screen 175 and various buttons (FIG. 18), the various buttons when depressed perform as follows: Button 140 turns on the power to the system. To use system manually or activate the system to automatic. Button 142 turns off the power to the system. System cannot be used automatically or manually. Button 144 runs the system fully automatically. Button 146 fills a desired sink bay until a water level sensor 84 (FIG. 12) instructs the controller unit 10 that the sink bay is full. In addition to selecting button 146, a sink bay must also be selected. A sink bay may be selected by pressing buttons 162, 164 or 166. Button 148 drains a desired sink bay. In addition to selecting button 148, a sink bay must also be selected. Button 150 provides hot water to a desired sink bay. In addition to selecting button 150, a sink bay must also be selected. In this case, the water will be provided until the button is again manually depressed. Button 152 provides cold water to a desired sink bay. In one method of selecting button 152, a sink bay must also be selected. In another method of selecting button 152, depression of only button 152 will provide cold water to the sanitize sink bay. Button 154 provides the temperature of a sink bay. In addition to selecting button 154, a sink bay must also be selected. Button 156 displays turbidity level in rinse bay. Button 158 displays the pH and alkalinity level in the wash bay. Button 160 displays quaternary ammonium level in sanitize bay. Wash bay button 162 to perform all tests and functions in combination with other command buttons. Rinse bay button 164 to perform all tests and functions in combination with other command buttons. Sanitize bay button 166 to perform all tests and functions in combination with other command buttons.

The LCD screen 175 (FIG. 18) may display information received by the controller unit, as well as, the current operation and time remaining for automatic drainage and refill. For example, the LCD may display water temperature, pH levels, turbidity levels, quaternary ammonium levels, and water levels.

Figure 19:
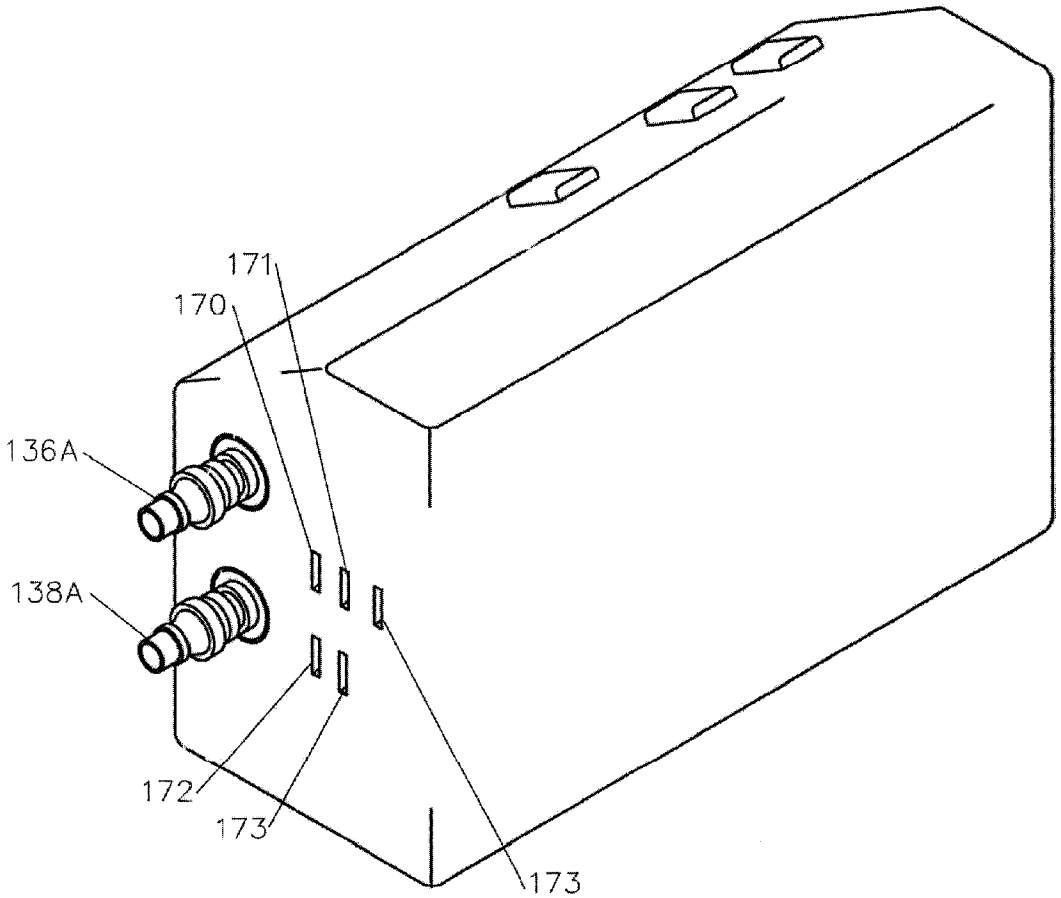
FIG. 19 is a front perspective view of the side and back wall mountable control panel.

Generally, the controller unit 10 has a plurality of ports that send and receive information from the detection wand 132 which monitors water temperature, ph levels, turbidity levels, quaternary ammonium levels, and a water level sensor 84 for controlling water levels. Also, in connection with water level sensor 84 and wet sensor 46 which is located in the throat of drain unit 11 above diverter 78, the controller unit 10 can regulate the flow of water in each sink bay by the opening and closing of diverter 78. In addition, the controller unit 10 is connected to the detergent/sanitizer distribution pump 22 with cable 110 which supplies chemicals through a small tube 90*a* to sink bays 24 and 28. More specifically, during the start of the fill cycle, the controller allows hot water inlet 16 to fill sink bays 24 and 26 and cold water inlet to fill sink bay 28 until reaching wet sensor 84. Simultaneously, a signal is relayed to detergent/sanitizer distribution pump 22 through cable 110 (FIG. 15A) to distribute detergent to sink bay 24 and sanitizer to sink bay 28. Furthermore, with respect to the ware washing process, the detection wand 132 is continuously monitoring the ph levels, turbidity levels, quaternary ammonium levels and water temperature. As these levels fall below FDA/EPA standards, a signal is relayed through cable 96 to drain unit 11 port 64 which relays through circuit board 74 back to controller unit 10 through data cable 112 all in conjunction with circuit board 74 relaying a signal to diverter 78 to open position sounding alarm 214 allowing liquid to drain. Finally, wet sensor 46 will relay a signal back to circuit board 74 once detecting water has fully drained, allowing the diverter 78 to electronically close and alarm 236 to stop. As diverter 78 rotates to the closed position 78B, circuit board 74 will relay a signal to data port 62 through data cable 112 that is connected to the controller unit 10 port 170, 171, 173 commanding the controller unit 10 to commence the fill cycle (FIG. 19).

The controller unit 10 may include a data log system that can be added for department management evaluation.

An indicator sound/light (as required by Chapter 4 of the FDA Code) will signal the dishwasher that the sink will soon drain, which will give them an opportunity to plan another wash and stay productive, by moving onto another task while the sink is refilling.

The device can be installed on any new or existing one or three bay commercial sink.

A wall mounted push button panel allows manual functions and an override system to ensure safety.

A manual safety disconnect is attached to drain for quick manual drain of each sink basin.

Through the use of a wireless base computer, one can manage the sinks by monitoring the levels and logging all of the data. This logged data can be transmitted to an individual or monitoring device by wired or wireless transmission to portable or stationary computing devices. This is vital information and protection against legal action stemming from customers claiming contamination and can be provided to government inspectors.

The draining of contaminated water can be on a timed cycle as well as automatically through the sensors; therefore, detergent as well as sanitizer is used which will maintain sales and guaranteed profits of products for sanitation companies.

The FDA requires food service establishments to maintain proper temperature levels and chemicals levels. For example:

FDA Food Code 2009: 4-501.112 Mechanical Ware washing Equipment, Hot Water Sanitization Temperatures.

A. In a mechanical operation, the temperature of the fresh hot water sanitizing rinse as it enters the manifold may not be more than 90° C. (194° F.), or less than:

1. For a stationary rack, single temperature machine, 74° C. (165° F.); or
2. For all other machines, 82° C. (180° F.) FDA Food Code 2009: 4-501.114 Manual and Mechanical Ware washing Equipment, Chemical Sanitization—Temperature pH, Concentration, and Hardness.

A. A chlorine solution shall have a minimum temperature based on the concentration and PH of the solution as listed in the following chart;

| Concentration | Minimum Temperature | |
|---|---|---|
| Range mg/L | pH 10 or less ° C. (° F.) | pH 8 or less ° C. (° F.) |
| 25-49 | 49 (120) | 49 (120) |
| 50-99 | 38 (100) | 24 (75) |
| 100 | 13 (55) | (55) |

B. An iodine solution shall have a:

1. Minimum temperature of 20° C. (68° F.),
2. PH of 5.0 or less or a PH no higher than the level for which the manufacturer specifies the solution is effective, and
3. Concentration between 12.5 mg/L and 25 mg/L;

C. A quaternary ammonium compound solution shall:

1. Have a minimum temperature of 24° C. (75° F.),
2. Have a concentration as specified under §7-204.11 and as indicated by the manufacturer's use directions included in the labeling, and
3. Be used only in water with 500 mg/L hardness or less or in water having hardness no greater than specified by the EPA-registered label use instructions.

Figure 20:
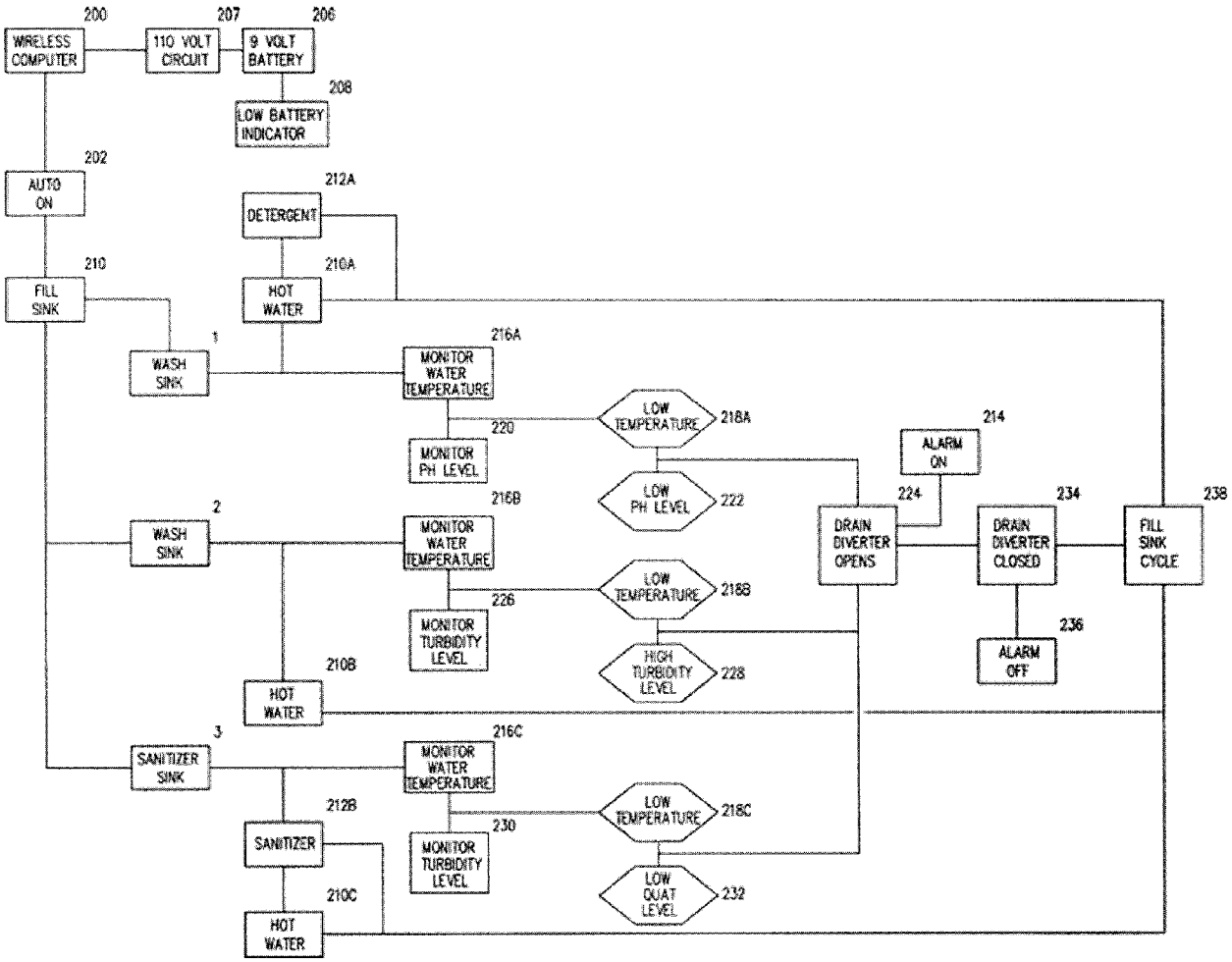
FIG. 20 is a flowchart diagram illustrating the operation of the computer unit.

Referring now to FIG. 20, wireless computer 200, also known as a controller unit can be powered up by 110 volts 207 or a 9 volt battery 206 with a low battery indicator 208. Preferably the system will be comprised of three sinks. With the auto on 202 button selected, the sink bay 210 shall fill with water. The wash sink 24 will receive hot water 210A, the rinse sink 26 will receive hot water 210B, and the sanitize sink 28 will receive cold water 210C. With the auto button in the off position, yet the on button activated, the system can then be controlled manually by selecting the desired functions and sink bay locations.

Subsequent to filling the bays with water, the system will fill the wash sink 24 with detergent 212A and the sanitize bay with sanitizer 212B.

During the wash, rinse, sanitize cycle, the system will monitor wash sink water temperature 216A and pH level, the rinse sink water temperature 216B and turbidity level 226, the sanitize sink 28 water temperature 218C and quaternary ammonium level 230. Should the controller unit receive a signal from one of its sensors indicating low or high water temperature 222, high turbidity 228, or low quaternary ammonium level 232, the controller unit shall invoke the opening one, two, or three of its diverter 224 by releasing the water from the sink bays as the alarm 214 sounds.

Preferably, three wet sensors 46 positioned in the throat of each drain unit 11 just above the diverter 78 shall indicate when the sink bay has extinguished all water residing within the bay. The wet sensor 46 shall indicate to the controller unit that the water is extinguished through the system; thereby the controller unit shall cause the diverter to close 234 as well as turning off the alarm 236. When the alarm 236 has stopped, the controller unit will recycle the process and fill the sink bays 238.

In an alternative embodiment, vibration member 131 transmits a sound wave in a liquid medium that is detectable by a sound sensor 87. The sound wave will become displaced by reflection or refraction dependent upon either the amount of quaternary ammonium or the level of turbidity inside a sink bay holding liquid. Sound sensor 87 will detect the wave. Each sound sensor 87 is in electrical communication with the controller unit. The controller unit shall calculate information from each sound sensor 87 to determine the quaternary ammonium or turbidity or both. The controller may calculate quaternary ammonium and turbidity from information received from at least one sound sensor 87, the information may be calculated through the logarithmic equation expressed as: $DT=SL+DI_T+TS-2TL-RL$ where; DT is the detection threshold; SL is the source level; $DI_T$ is the directivity of the source; TS is the target strength; TL is transmission loss; RL reverberation level.

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

All patents and publications mentioned in this specification are indicative of the levels of those skilled in the art to which the invention pertains. All patents and publications are herein incorporated by reference to the same extent as if each individual publication was specifically and individually indicated to be incorporated by reference. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An automated commercial sink for cleaning of kitchen ware, comprising:

a wash bay, a rinse bay, and a sanitizer bay, each said bay having a bottom with side walls leading to an open top, said bottom having a drain;

a diverter valve coupled to each said drain of each said bay;

at least one controller for maintaining a predetermined water level in each said bay, said controller coupled to a hot water source and a cold water source;

a temperature sensor mounted within each said bay and electrically coupled to said controller, said controller adjusting the water temperature in each bay and diverting fluid to the drain and replacing with FDA/EPA required temperature levels;

a dispensing unit fluidly coupled to said sanitizer sink and electrically connected to said controller unit;

means for measuring quaternary ammonium level in said sanitizer bay electrically coupled to said controller, said controller adjusting the quaternary ammonium level in said sanitizer bay by diverting fluid to the drain and replacing with required FDA/EPA sanitizer level.

2. The automated commercial sink for cleaning of kitchen ware according to claim 1 including a pH sensor fluidly communicating with said wash bay and electrically coupled to said controller unit, said controller adjusting the pH by diverting fluid to the drain and replacing with FDA/EPA required detergent and water temperature level.

3. The automated commercial sink for cleaning of kitchen ware according to claim 1 including a means for measuring turbidity in said rinse bay.

4. The automated commercial sink for cleaning of kitchen ware according to claim 1 including a means for measuring turbidity in said rinse bay wherein said means for measuring turbidity is further defined by a second light and a second sensor, said second light and said second sensor detecting a concentration of turbidity by measuring the light intensity of said second light, said controller adjusting the turbidity level in said bay by diverting fluid to the drain until a predetermined turbidity level and FDA/EPA required hot water temperature level.

5. The automated commercial sink for cleaning of kitchen ware according to claim 1 wherein said means for measuring quaternary ammonium is performed by a light sensor receptive to a light generator.

6. The automated commercial sink for cleaning of kitchen ware according to claim 1 wherein said diverter is electrically reciprocated between an open position and a closed position by said controller.

7. The automated commercial sink for cleaning of kitchen ware according to claim 1 wherein said diverter is hydraulically reciprocated between an open position and a closed position by said controller.

8. The automated commercial sink for cleaning of kitchen ware according to claim 1 wherein said diverter is pneumatically reciprocated between an open position and a closed position by said controller.

9. The automated commercial sink for cleaning of kitchen ware according to claim 1 wherein said means for measuring quaternary ammonium is performed by a sound sensor that detects a sound from a sound generator, said controller unit measuring a time of sound for detecting a concentration of quaternary ammonium.

10. A process for maintaining FDA/EPA required levels of a sanitizer, a detergent, water temperature, and water clarity for cleaning of kitchen ware, comprising the steps of:

positioning three bays each having a bottom, side walls and an open top adjacent to each other, each said bottom having a drain;

coupling a diverter valve to said drain of each said bay;

monitoring a fluid level in each said bay and maintaining said fluid level by introducing fluid from a water source;

measuring a temperature within each said bay and maintaining said temperature by introducing hot water and cold water into each bay and diverting water to the drain until a predetermined temperature is obtained;

coupling a dispensing unit to said each said bay;

calculating a pH level in one said bay and adjusting a pH level by diverting water to the drain and replacing with hot water and pH adjusting fluid from said dispensing unit;

detecting the turbidity level in one said bay and adjusting the turbidity level by diverting water to the drain wherein water introduced from said hot water source and said cold water source maintains the fluid level;

detecting quaternary ammonium level in one said bay and adjusting said sanitizer level by diverting water to said drain wherein water introduced from said cold water source and said hot water source maintains fluid level.

11. The process for maintaining FDA/EPA required levels of sanitizer, detergent, water temperature, and water clarity for cleaning of kitchen ware of claim 10, further comprising the step of:

calculating the pH level in one said bay and adjusting the pH level by diverting fluid to the drain and replacing with hot water and detergent from said dispensing unit.

12. The process for maintaining FDA/EPA required levels of sanitizer, detergent, water temperature, and water clarity for cleaning of kitchen ware of claim 10, further comprising the step of:

measuring the quaternary ammonium level from a detectable level of a light captured by a light sensor, wherein said light is produced by a light generator.

13. The process for maintaining FDA/EPA required levels of sanitizer, detergent, water temperature, and water clarity for cleaning of kitchen ware of claim 10, further comprising the step of:

reciprocating said diverter valve between an open position and a closed position by said controller.

14. The process for maintaining FDA/EPA required levels of sanitizer, detergent, water temperature, and water clarity for cleaning of kitchen ware of claim 10, further comprising the step of:

measuring the quaternary ammonium level from a detectable level of a sound captured by a sound sensor, wherein said sound output is produced by a sound generator.

15. The process for maintaining FDA/EPA required levels of sanitizer, detergent, water temperature, and water clarity for cleaning of kitchen ware of claim 10, further includes a controller unit coupled to said diverter valve and said dispensing unit, wherein said controller unit:

releases water into at least one of said bays;

dispensing a cleaning solution to at least one of said bays, said cleaning selected from the group consisting of detergent or quaternary ammonium; and reciprocates said diverter between an open position and a closed position.

16. An automated commercial sink for cleaning of kitchen ware, comprising:

a wash bay, a rinse bay, and a sanitizer bay, each said bay having a bottom with side walls leading to an open top, said bottom having a drain;

a diverter valve coupled to each said drain of each said bay;

at least one controller for maintaining a predetermined fluid level in each said bay;

a temperature sensor mounted within each said bay and electrically coupled to said controller, said controller operable to adjust water temperature in each bay by diverting said water to said drain and replacing with FDA/EPA required water temperature levels;

a pH sensor fluidly communicating with said wash bay and electrically coupled to said controller unit, said controller adjusting the pH by diverting water to the drain and replacing with FDA/EPA required detergent, hot and cold water;

a dispensing unit fluidly coupled to said sanitizer sink and electrically connected to said controller unit, said controller operably disburses a cleaning liquid from said dispensing unit to said wash bay and said sanitizer bay, said cleaning liquid selected from the group consisting of a detergent and a sanitizer;

means for measuring sanitizer level in said sanitizer bay, said means for measuring electrically coupled to said controller, said controller adjusting the sanitizer level in said sanitizer bay by diverting water to the drain and replacing with required FDA/EPA sanitizer hot water and cold water levels.

17. The automated commercial sink for cleaning of kitchen ware according to claim 16 wherein said controller includes a plurality of buttons, one said plurality of buttons operates to activate an automatic system mode;

wherein said controller operates the disbursement of said fluid source; and wherein said controller operates the disbursement of said cleaning liquid.

18. The automated commercial sink for cleaning of kitchen ware according to claim 16 wherein said controller includes a plurality of actuators, one of said actuators operates to release water into one said bay.

19. The automated commercial sink for cleaning of kitchen ware according to claim 18 wherein one of said actuators operates to dispense said cleaning solution to one said bay.

20. The automated commercial sink for cleaning of kitchen ware according to claim 18 wherein one of said actuators operates to release water into one said bay.

21. The automated commercial sink for cleaning of kitchen ware according to claim 18 wherein one of said actuators operates to reciprocate open said diverter valve and diverting fluid to said drain.

22. The automated commercial sink for cleaning of kitchen ware according to claim 18 wherein one of said actuators operates to close said diverter valve.

* * * * *